US010141646B2

(12) United States Patent
Shiozaki et al.

(10) Patent No.: US 10,141,646 B2
(45) Date of Patent: Nov. 27, 2018

(54) ARRAY ANTENNA DEVICE

(71) Applicant: Panasonic Intellectual Property Management Co., Ltd., Osaka (JP)

(72) Inventors: Ryosuke Shiozaki, Tokyo (JP); Yuichi Kashino, Ishikawa (JP); Junji Sato, Tokyo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 181 days.

(21) Appl. No.: 14/975,624

(22) Filed: Dec. 18, 2015

(65) Prior Publication Data

US 2016/0248159 A1 Aug. 25, 2016

(30) Foreign Application Priority Data

Feb. 24, 2015 (JP) ..... 2015-033970
May 14, 2015 (JP) ..... 2015-098844
Aug. 10, 2015 (JP) ..... 2015-157877

(51) Int. Cl.
*H01Q 21/00* (2006.01)
*H01Q 7/00* (2006.01)
*H01Q 13/20* (2006.01)
*H01Q 1/32* (2006.01)

(52) U.S. Cl.
CPC ..... *H01Q 7/00* (2013.01); *H01Q 13/206* (2013.01); *H01Q 21/0075* (2013.01); *H01Q 1/3233* (2013.01); *H01Q 21/0006* (2013.01)

(58) Field of Classification Search
CPC ..... H01Q 9/0464; H01Q 21/0006; H01Q 21/0075; H01Q 21/06; H01Q 21/08
See application file for complete search history.

(56) References Cited

U.S. PATENT DOCUMENTS 6,891,508 B2 * 5/2005 Inoue ..... H01Q 1/38 343/725
8,193,990 B2 * 6/2012 Nakabayashi ..... H01Q 21/0075 343/700 MS
2009/0309804 A1 * 12/2009 Chen ..... H01Q 21/0075 343/893
2010/0026584 A1 2/2010 Nakabayashi et al.
2017/0005405 A1 * 1/2017 Kim ..... H01Q 1/3233

FOREIGN PATENT DOCUMENTS

JP 2010-041090 2/2010

* cited by examiner

*Primary Examiner* — Tho G Phan
*Assistant Examiner* — Patrick Holecek
(74) *Attorney, Agent, or Firm* — Seed IP Law Group LLP

(57) ABSTRACT

An array antenna device of this disclosure includes a substrate, a strip conductor with a linear-shape, which is provided on the substrate, and a power feeder that feeds power to the strip conductor, and a plurality of loop elements, a conductor plate, and a plurality of feeding elements. The plurality of loop elements are provided on a first surface of the substrate, and are located along the strip conductor with a specified spacing from each other. Each of the plurality of loop elements has a loop-shape with a notch. The plurality of feeding elements are connected to the strip conductor, and each has a shape extending along a portion of an outer edge of corresponding one of the plurality of loop elements. The conductor plate is provided on a second surface of the substrate.

16 Claims, 19 Drawing Sheets

ARRAY ANTENNA DEVICE

BACKGROUND

1. Technical Field

The present disclosure relates to an array antenna device that irradiates radio waves.

2. Description of the Related Art

Examples of an array antenna device used for radio communication or radio positioning include an array antenna device having a microstrip configuration.

Japanese Patent No. 5091044 discloses an array antenna device in which a plurality of array elements are arranged, each of the array elements including a sub-feeding strip line connected to a main feeding strip line, a rectangular radiating element connected to a terminal end of the sub-feeding strip line, and a stub provided between the radiating element and the main feeding strip line.

According to the above-described conventional techniques of Japanese Patent No. 5091044, however, the control range of the radiation amount of the radio waves from the array element is small, which is approximately 30% to 40%, and it is thus difficult to suppress side lobes of the radio waves radiated from the array antenna device. Besides, according to the conventional techniques of Japanese Patent No. 5091044, the array element is large in size and when a configuration in which a plurality of array antenna devices are arranged in a short-length direction of a main feeding strip line is employed, spacings in the short-length direction increase and upsizing of the whole device may be caused. The increase in the spacings in the short-length direction may allow grating lobes to occur easily, and the rise in the side lobes may cause decrease in gain and when the array antenna device is used in a radar device, incorrect detection may be caused.

SUMMARY

One non-limiting and exemplary embodiment provides an array antenna device, which enables suppression of side lobes of radio waves radiated and downsizing of an antenna.

In one general aspect, the techniques disclosed here feature an array antenna device including: a substrate; a strip conductor with a linear-shape, which is provided on the substrate; a power feeder that feeds power to the strip conductor; a plurality of loop elements which are provided on a first surface of the substrate and are located along the strip conductor with a specified spacing from each other, each of the plurality of loop elements having a loop-shape with a notch; a conductor plate provided on a second surface of the substrate; and a plurality of feeding elements connected to the strip conductor, each of the plurality of feeding elements having a shape extending along a portion of an outer edge of corresponding one of the plurality of loop elements.

According to the present disclosure, side lobes of radio waves radiated can be suppressed and an antenna can be downsized.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Circumstances Underlying Present Disclosure

The circumstances underlying the present disclosure are described first. Specifically, a configuration on which the present disclosure focuses when an array antenna device is used for a radar device mounted in a vehicle is described.

Typically, radio waves radiated from a directional antenna, such as an array antenna, include a side lobe in a direction shifted from a desired direction in addition to a main lobe in the desired direction.

The radar device mounted in the vehicle causes the main lobe to be in the desired direction so as to detect an object in the desired direction. However, when the radar device radiates a radio wave that includes a significant side lobe, incorrect detection indicating that the object would be present in the desired direction may be caused by the influence of the side lobe even if no object is present in the desired direction.

Described below is a case where the array antenna disclosed in Japanese Patent No. 5091044 is used as an example of the radar device mounted in a vehicle.

Figure 1:
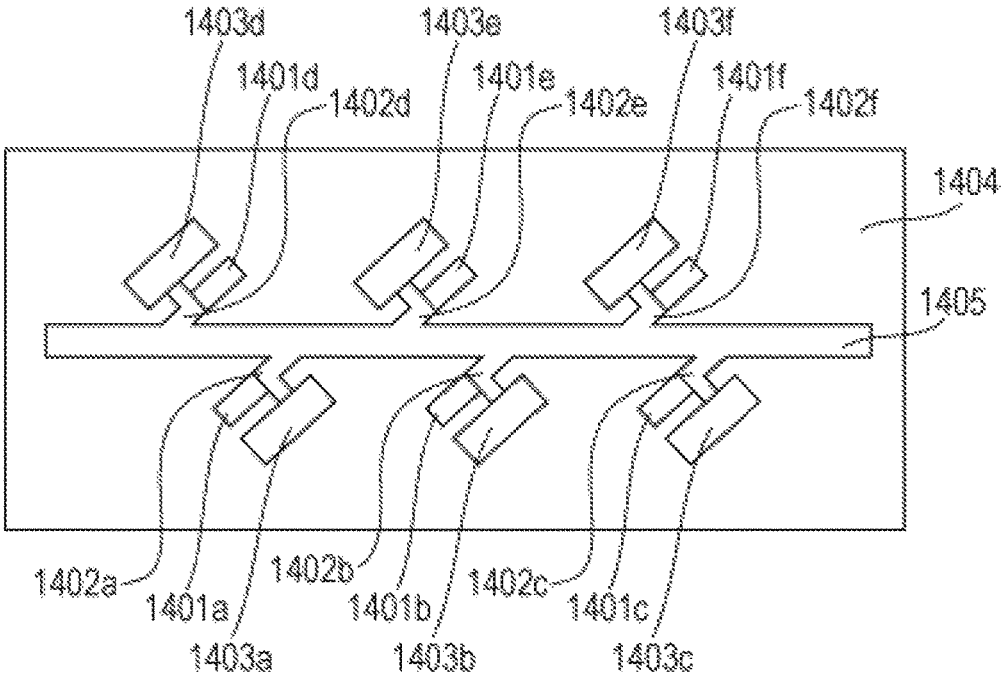
FIG. 1 PRIOR ART
FIG. 1 illustrates a configuration of the array antenna according to prior art.

FIG. 1 illustrates a configuration of the array antenna according to Japanese Patent No. 5091044. The array antenna illustrated in FIG. 1 is a microstrip array antenna having a configuration in which a strip conductor is formed on a dielectric substrate 1404 with a back surface on which a ground plate of the conductor is formed.

The strip conductor formed on the dielectric substrate 1404 includes a linear main feeding strip line 1405 and a plurality of array elements, which are arranged at predetermined spacings along at least one of both sides of the main feeding strip line 1405 so as to be connected to the main feeding strip line 1405, and in the example of FIG. 1, the number of the array elements is six.

Specifically, the six array elements include sub-feeding strip lines 1402*a* to 1402*f* connected to the main feeding strip line 1405, rectangular radiating antenna elements 1403*a* to 1403*f* connected to corresponding ends of the sub-feeding strip lines 1402*a* to 1402*f*, and stubs 1401*a* to 1401*f* connected at predetermined positions between the positions at which the sub-feeding strip lines 1402*a* to 1402*f* are connected to the main feeding strip line 1405 and the positions at which the sub-feeding strip lines 1402*a* to 1402*f* are connected to the radiating antenna elements 1403*a* to 1403*f*, respectively.

In the array antenna illustrated in FIG. 1, the array elements are arranged so that the directions of the electrical fields caused by the current that flows through the stubs 1401*a* to 1401*f* are the same as the directions of the electrical fields from the radiating antenna elements 1403*a* to 1403*f*. Accordingly, the reflection amount of the radio waves from the radiating antenna elements 1403*a* to 1403*f* can be made small while achieving a high radiation amount, and in addition, undesired cross polarization components can be suppressed.

According to the conventional techniques of Japanese Patent No. 5091044, which are illustrated in FIG. 1, however, the control range of the radiation amount of the radio waves from the array element is small, which is approximately 30% to 40%, and it is thus difficult to suppress the side lobes of the radio waves radiated from the array antenna device. Besides, according to the conventional techniques of Japanese Patent No. 5091044, each array element is large in size and when a configuration in which a plurality of array antenna devices are arranged in the short-length direction of a main feeding strip line is employed, spacings in the short-length direction increase and upsizing of the whole device is caused. The increase in the spacings in the short-length direction may allow grating lobes to occur easily, and the rise in the side lobes may cause decrease in gain and when the array antenna device is used in a radar device, incorrect detection may be caused.

Thus, as a result of assiduous studies in view of the above-described issues, the present inventors have found that modifying the shape and the feeding configuration of an antenna element included in each array element can lead to suppression of the side lobes of the radio waves radiated by an array antenna device and reduction in the cross polarization ratio, and have reached the present disclosure.

Embodiments of the present disclosure are described in detail below with reference to the drawings. The embodiments described below are examples and are not intended to limit the present disclosure.

Embodiment 1

Figure 2A:
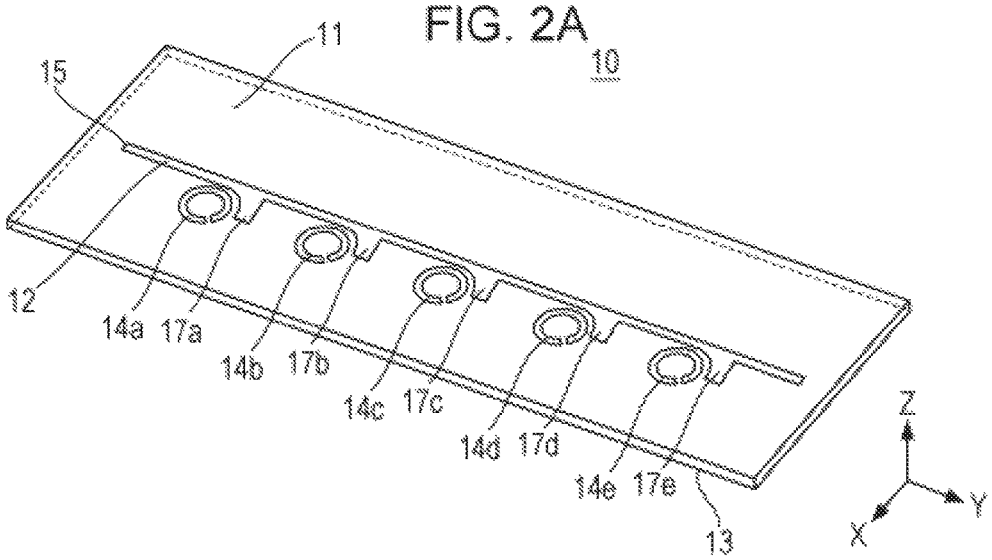
FIG. 2A is a perspective view illustrating an external appearance of an array antenna device according to Embodiment 1 of the present disclosure.
Figure 2B:
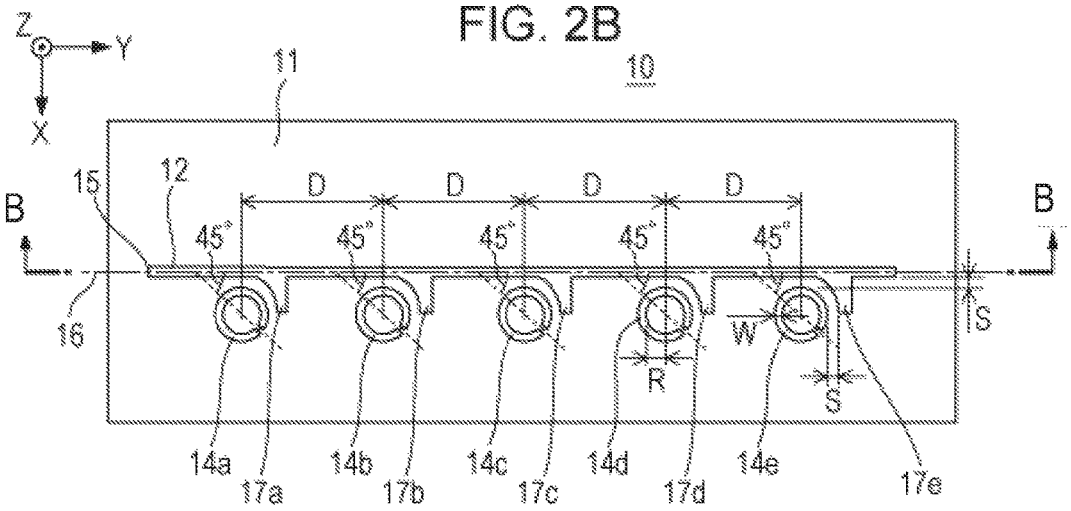
FIG. 2B is a plan view of the array antenna device according to Embodiment 1 of the present disclosure.
Figure 2C:
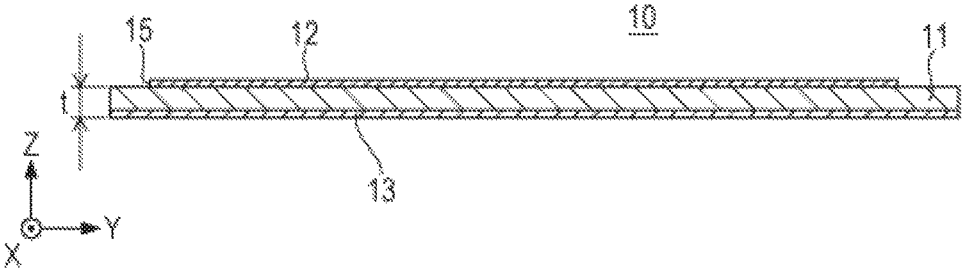
FIG. 2C is a sectional view of the array antenna device according to Embodiment 1 of the present disclosure.

FIG. 2A is a perspective view illustrating the external appearance of an array antenna device 10 according to Embodiment 1 of the present disclosure. FIG. 2B is a plan view of the array antenna device 10 according to Embodiment 1 of the present disclosure. FIG. 2C is a sectional view of the array antenna device 10 according to Embodiment 1 of the present disclosure. FIG. 2C illustrates Section B-B indicated by a broken line 16 across the array antenna device 10 illustrated in FIG. 2B. In FIGS. 2A to 2C, Y represents the long-length direction of the array antenna device 10, X represents the short-length direction, which is the width direction, and Z represents the thickness direction.

The array antenna device 10 includes a substrate 11, a strip conductor 12 arranged on one surface of the substrate 11, which is also referred to as a first surface, a plurality of loop elements 14*a* to 14*e*, and a plurality of feeding elements 17*a* to 17*e*, a conductor plate 13 arranged on another surface of the substrate 11, which is also referred to as a second surface, and an input end 15 provided at one end of the strip conductor 12. The plurality of loop elements 14*a* to 14*e* are arranged on the first surface of the substrate 11 at predetermined spacings D along the strip conductor 12. The feeding elements 17*a* to 17*e* are connected to the strip conductor 12 and each of the feeding elements 17*a* to 17*e* has a shape extending along a portion of the outer edge of corresponding one of the loop elements 14*a* to 14*e*. A pair of one of the loop elements 14*a* to 14*e* and corresponding one of the feeding elements 17*a* to 17*e* constitutes an antenna element. The strip conductor is also referred to as a feeding line.

For example, the substrate 11 is a double-sided copper-clad substrate, which has a thickness t and a dielectric constant εr. The strip conductor 12 is formed by, for example, a copper foil pattern on one surface of the substrate 11. The conductor plate 13 is formed by, for example, a copper foil pattern on another surface of the substrate 11. In the array antenna device 10 illustrated in FIGS. 2A to 2C, the strip conductor 12 and the conductor plate 13 constitute a microstrip line.

Each of the loop elements 14*a* to 14*e* is a loop-shaped element formed on the one surface of the substrate 11 on which the strip conductor 12 is formed and the loop-like shape includes a notch portion. Each of the loop elements 14*a* to 14*e* is a conductor shaped like a circular ring, which has an inner radius R and an element width W. Each of the loop elements 14*a* to 14*e* is arranged along the strip conductor 12 so as to be apart from the adjacent loop element by the predetermined spacing D in the direction Y. Although the array antenna device described with reference to FIGS. 2A to 2C has five loop elements, that is, 14*a* to 14*e*, the present disclosure is not limited thereto.

The notch portion of each of the loop elements 14*a* to 14*e* is provided in a 45-degree direction relative to the broken line 16 that is parallel to the strip conductor 12. Each of the loop elements 14*a* to 14*e* has an open loop configuration with an outer edge length that constitutes approximately one wavelength of the radiated radio waves.

As regards each of the loop elements 14*a* to 14*e* according to the present disclosure, the direction of the notch portion and the perimeter are mere examples and are not limited thereto.

The input end 15 is one of end portions of the strip conductor 12, to which power is supplied, and is connected to a power feeder described below with reference to FIG. 7 and the like.

The feeding elements 17*a* to 17*e* are arranged so as to planarly project toward the side of the strip conductor 12, on which the loop elements 14*a* to 14*e* are provided, and are formed by a copper foil pattern so as to be integrated with the strip conductor 12. The feeding elements 17*a* to 17*e* are electromagnetically coupled with the corresponding loop elements 14*a* to 14*e* and supply power to the loop elements 14*a* to 14*e*, respectively. Each of the feeding elements 17*a* to 17*e* includes at least a first side connected to the strip conductor 12 and a second side, which is apart from part of the outer edge of corresponding one of the loop elements 14*a* to 14*e* by a predetermined spacing S and approximately parallel thereto.

In other words, the second side of each of the feeding elements 17*a* to 17*e* forms an arc of a circle drawn when the center of the corresponding loop element serves as the center of the circle and the sum of the inner radius R, the width W of the loop element, and the spacing S serves as the radius of the circle.

In the array antenna device 10 illustrated in FIGS. 2A to 2C, each of the loop elements 14*a* to 14*e* is arranged so as to be apart from the strip conductor 12 and corresponding one of the feeding elements 17*a* to 17*e* by the predetermined spacing S. Accordingly, the loop elements 14*a* to 14*e* are electromagnetically coupled with the strip conductor 12 and the feeding elements 17*a* to 17*e* (see FIG. 2B).

According to the above-described configuration, the power fed from the input end 15 of the strip conductor 12 is supplied in the order from the loop elements 14*a* to 14*e* due to the electromagnetic coupling of the strip conductor 12 and the feeding elements 17*a* to 17*e* with the loop elements 14*a* to 14*e*. That is, the array antenna device 10 operates as an array antenna in which each of the loop elements 14*a* to 14*e* serves as a radiating element.

By setting the spacing D between the loop elements to approximately λg, which represents an effective wavelength of a signal propagated through the strip conductor 12, each of the loop elements 14*a* to 14*e* can be excited in phase and the radiation directivity of a beam that has the maximum gain in the direction +Z can be achieved.

Figure 3:
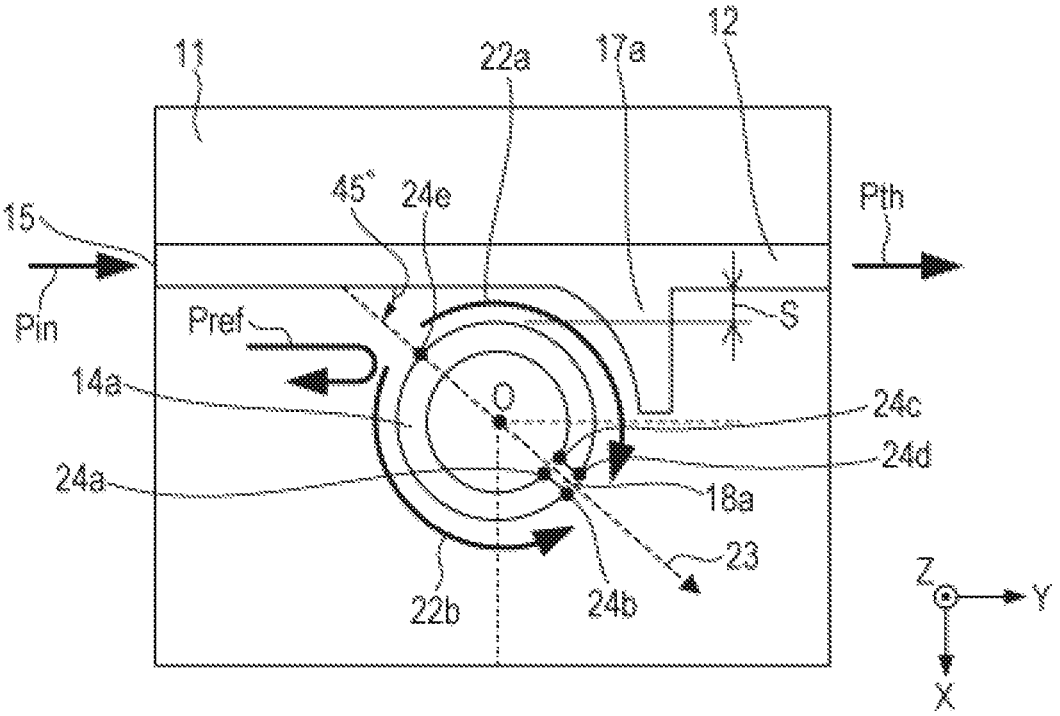
FIG. 3 is a diagram for describing the radiation principle of radio waves from a loop element.

The radiation principle of radio waves from each of the loop elements 14*a* to 14*e* in the array antenna device 10 according to Embodiment 1 is now described with reference to FIG. 3. FIG. 3 is a diagram for describing the radiation principle of the radio waves from the loop element 14*a*. Although FIG. 3 is used to describe the loop element 14*a* and the feeding element 17*a* in the array antenna device 10 in particular, the radiation principles of the radio waves from the other loop elements 14*b* to 14*e* are similar.

The electromagnetic coupling of the strip conductor 12 and the feeding element 17*a* with the loop element 14*a* causes part of power Pin supplied from the input end 15 (see FIGS. 2A to 2C) to be radiated from the loop element 14*a*. A notch portion 18*a* of the loop element 14*a* is provided at a position at which the angle between an arrow 23, which connects a center O of the loop element 14*a* and an approximate center of the notch portion 18*a*, and the long-length direction of the strip conductor 12 is 45 degrees.

The approximate center of the notch portion 18*a* is a middle point of a line segment that connects end points 24*a* and 24*c* on the inner edge side of the notch portion 18*a*. That is, the notch portion 18*a* is provided at the position at which the angle between the arrow 23, which connects the center O of the loop element 14*a* and the middle point of the line segment connecting the end points 24*a* and 24*c*, and the long-length direction of the strip conductor 12 is 45 degrees.

End points on the outer edge side of the notch portion 18*a* are referred to as points 24*b* and 24*d*, and a point at which the arrow 23 and the outer edge of the loop element 14*a* meet is referred to as an intersection point 24*e*. On the outer edge side of the loop element 14*a*, the length from the point 24*b* to the intersection point 24*e* and the length from the point 24*d* to the intersection point 24*e* are approximately identical and each length is approximately ½λg.

On the loop element 14*a*, current in a direction indicated by an arrow 22*a* and current in a direction indicated by an arrow 22*b* are caused by providing the notch portion 18*a* at the position indicated in FIG. 3.

Thus, the loop element 14*a* operates as a radiating element, which has polarized waves in a direction rotated by 45 degrees from the direction Y parallel to the strip conductor 12 in the direction +X, that is, the direction of the arrow 23. Although FIG. 3 is used to describe a case where the notch portion 18*a* is provided in the loop element 14*a* at the position shifted in the direction +X by 45 degrees from the direction +Y, characteristics of waves obliquely polarized in the direction of the arrow 23 can be similarly obtained even if the notch portion is provided at the position shifted in the direction −X by 45 degrees from the direction −Y.

The power in the loop element 14*a* except the radiation power includes flow-through power Pth and reflection power Pref, which returns to the input end 15 because of the impedance mismatch between the strip conductor 12 and the loop element 14*a*. Thus, the radiation power from the loop element 14*a* has a value determined by subtracting the flow-through power Pth and the reflection power Pref from the input power Pin. The flow-through power Pth serves as the input power of the loop element 14*b*, and similar operations are performed in the loop elements 14*c*, 14*d*, and 14*e*, which follow the loop element 14*b*.

The radiation amount of the radio waves radiated from the loop element 14*a* is controlled on the basis of the coupling amount of the electromagnetic coupling of the strip conductor 12 and the feeding element 17*a* with the loop element 14*a*. The difference in the coupling amount, which depends on the presence or absence of the feeding element 17*a*, is described below.

Figure 4A:
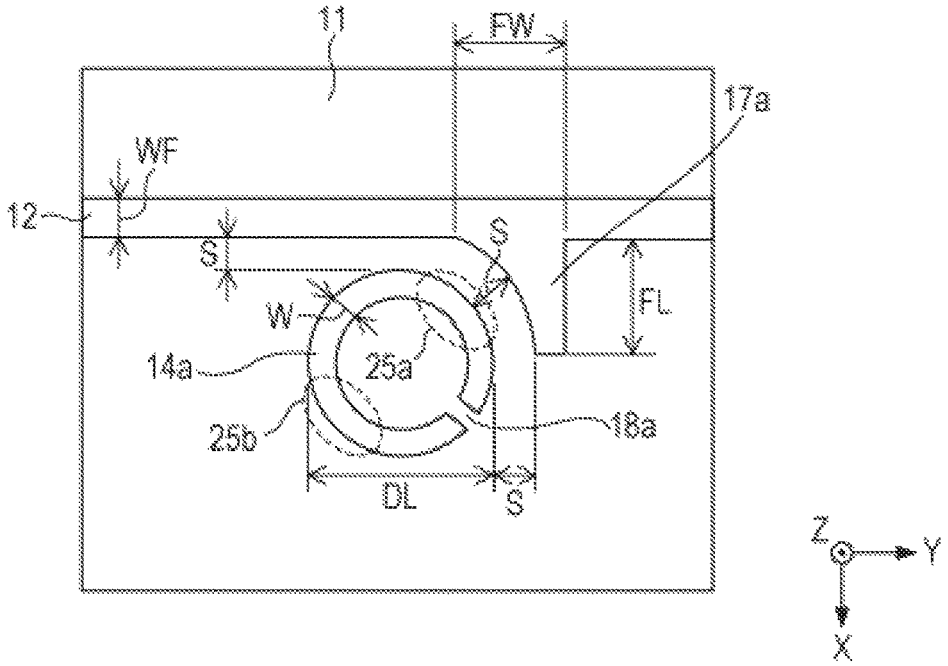
FIG. 4A illustrates a configuration in which a feeding element is provided.
Figure 4B:
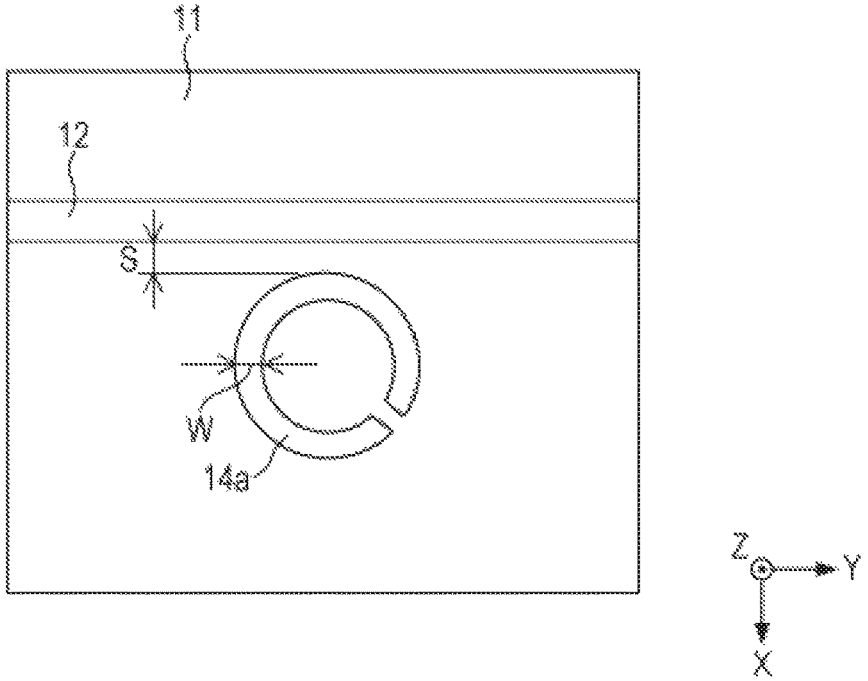
FIG. 4B illustrates a configuration in which the feeding element is not provided.
Figure 5:
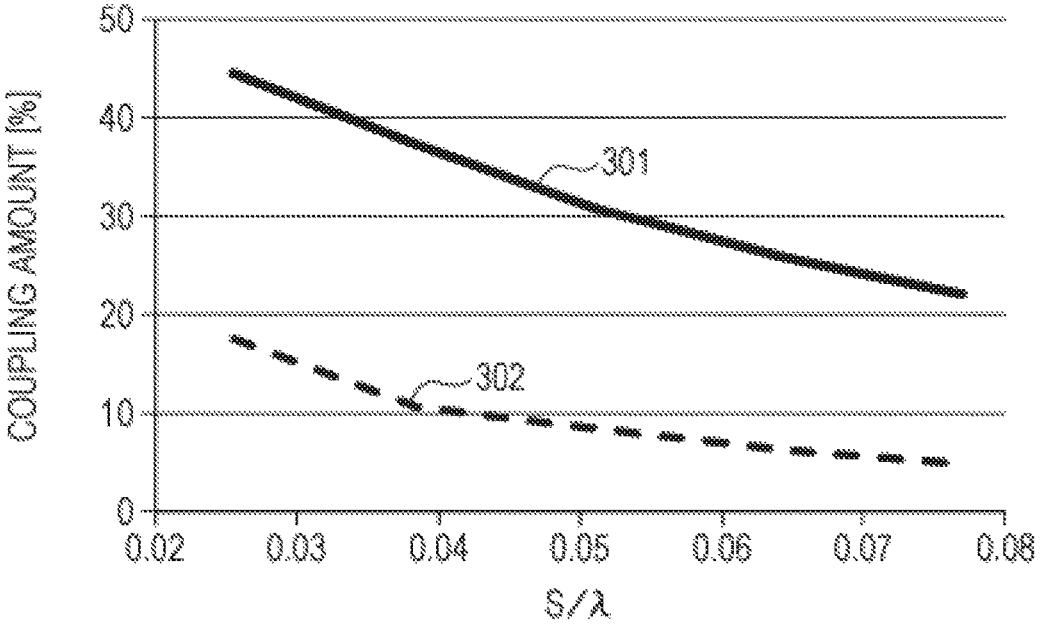
FIG. 5 illustrates how coupling amounts fluctuate as a predetermined spacing changes in the configurations illustrated in FIGS. 4A and 4B.

FIG. 4A illustrates a configuration in which the feeding element 17*a* is provided and FIG. 4B illustrates a configuration in which the feeding element 17*a* is not provided. FIG. 5 illustrates how the coupling amounts fluctuate as the spacing S changes in the configurations illustrated in FIGS. 4A and 4B.

The fluctuations in the coupling amounts illustrated in FIG. 5 are calculated by giving respective values to the sizes of the substrate 11, the strip conductor 12, the loop element 14*a*, and the feeding element 17*a* in each of FIGS. 4A and 4B. Specifically, the thickness t of the substrate 11 is 0.06λ, where λ, represents a free space wavelength at an operating frequency, and the dielectric constant εr of the substrate 11 is 3.4. A width WF of the strip conductor 12 is 0.05λ. A diameter DL of the loop element 14*a* on the outer edge side is 0.22λ, and the element width W of the loop element 14*a* is 0.04λ. A length FW of the feeding element 17*a* in the direction Y is 0.17λ, and a length FL of the feeding element 17*a* in the direction X is 0.1λ.

The above-mentioned values are mere examples and the sizes of the substrate 11, the strip conductor 12, the loop element 14*a*, and the feeding element 17*a* according to the present disclosure are not limited to these values.

In the graph in FIG. 5, the lateral axis indicates the length of the spacing S relative to the wavelength λ, and the longitudinal axis indicates the coupling amount on a percentage basis while the amount of the input power is assumed to be 100%. A solid line 301 indicates the fluctuations in the coupling amount according to the configuration in FIG. 4A, and a broken line 302 indicates the fluctuations in the coupling amount according to the configuration in FIG. 4B.

In the graph illustrated in FIG. 5, the coupling amount increases as the spacing S is smaller. This is because the electromagnetic coupling between the strip conductor 12 and the loop element 14*a* is strengthened when the spacing S is small. In addition, compared to the broken line 302 that indicates the case without the feeding element 17*a*, the solid line 301 that indicates the case with the feeding element 17*a* demonstrates that the coupling amount is increased although the spacing S is identical. As for the current distributed over the loop element 14*a*, standing waves occur from the notch portion 18*a*, and the current values are high in ranges 25*a* and 25*b* surrounded by broken lines in oval shapes in FIG. 4A since the ranges 25*a* and 25*b* correspond to the antinodes of the standing waves. Thus, the spacing between the feeding line and the range 25*a* surrounded by the broken line is reduced by providing the feeding element 17*a* and, compared to the case without the feeding element 17*a*, which is illustrated in FIG. 4B, a high coupling amount can be achieved.

Described below is the relation between the size of the feeding element 17*a*, which is specifically the length FL of the feeding element 17*a* in the direction X, and the coupling amount in the configuration illustrated in FIG. 4A.

Figure 6:
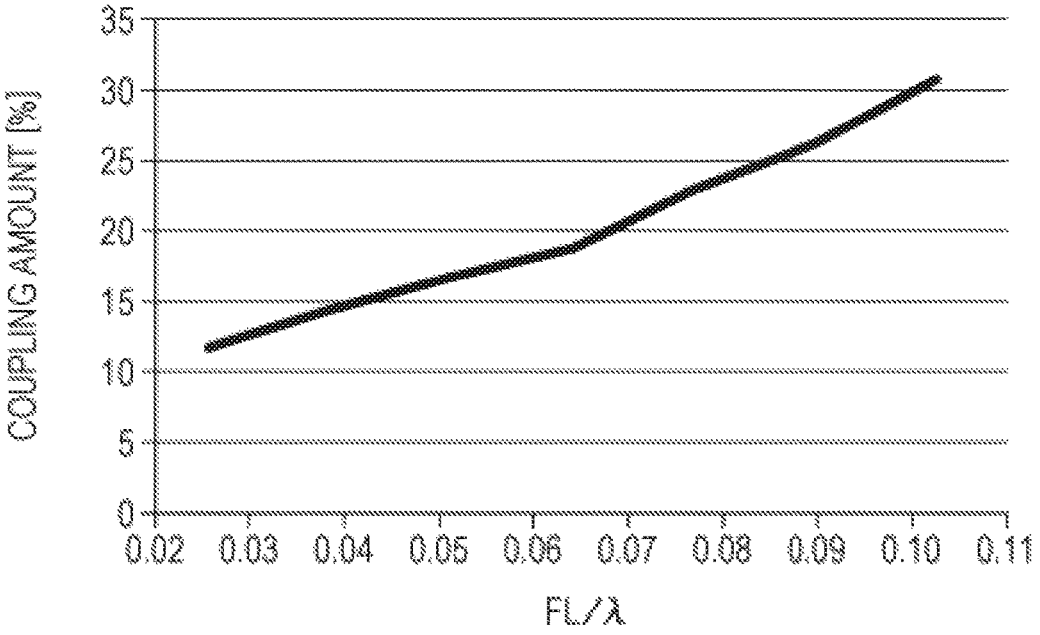
FIG. 6 is a graph illustrating fluctuations in the coupling amount in a case where a predetermined length of a feeding element in the short-length direction in the configuration in FIG. 4A is changed.

FIG. 6 is a graph illustrating fluctuations in the coupling amount in a case where the length FL of the feeding element 17*a* in the direction X in the configuration in FIG. 4A is changed. In the graph illustrated in FIG. 6, the lateral axis indicates the length FL in the direction X relative to the wavelength λ, and the longitudinal axis indicates the coupling amount on a percentage basis while the amount of the input power is assumed to be 100%.

Except the spacing S assumed to be 0.05λ, and the length FL of the feeding element 17*a* in the direction X, the sizes of the substrate 11, the strip conductor 12, the loop element 14*a*, and the feeding element 17*a* are similar to those described with reference to FIG. 5.

In the graph illustrated in FIG. 6, the coupling amount increases as the length FL of the feeding element 17*a* is larger. This is because as the length FL of the feeding element 17*a* is larger, the range in which the feeding line made up of the strip conductor 12 and the feeding element 17*a* is parallel to the loop element 14*a* increases, and the electromagnetic coupling between the feeding line and the loop element 14*a* is strengthened.

As described above, in the array antenna device 10 according to Embodiment 1, the coupling amount can be adjusted in a wide range by combining the spacing S between the feeding element 17*a* and the loop element 14*a*, and the length FL of the feeding element 17*a* in the direction X. For example, when a substrate having the thickness and the dielectric constant described with reference to FIG. 4A as an example is used, the coupling amount can be controlled in a range from approximately 5% to 70%.

Furthermore, in the plurality of loop elements 14*a* to 14*e* and the corresponding feeding elements 17*a* to 17*e*, different coupling amounts can be achieved in the loop elements 14*a* to 14*e* by adjusting the spacing S and the length FL of each of the feeding elements 17*a* to 17*e* in the direction X individually for each loop element.

Moreover, since the loop element 14*a* can ensure the length of ½ wavelength on an arc rather than on a straight line and the antenna element can be downsized, the length in the short-length direction of the strip conductor 12, that is, the direction X can be reduced.

A configuration in which the array antenna device 10 illustrated in FIGS. 2A to 2C is expanded is now described. FIG. 7 is a plan view of another array antenna device 100 according to Embodiment 1 of the present disclosure.

The array antenna device 100 chiefly includes a power feeder 28, a first subarray 29*a*, and a second subarray 29*b*. Each of the first subarray 29*a* and the second subarray 29*b* has a configuration in which a patch antenna 26 is provided as a microstrip antenna element at an end portion, which is opposite the end portion at which the power feeder 28 is provided.

In the array antenna device 100, the first subarray 29*a* and the second subarray 29*b* are located to be point symmetry with respect to an antenna central point 27 center. In connection with the patch antenna 26, the end portion of the strip conductor 12 is partially bent by 45 degrees so as to have polarized waves in a direction rotated in the direction +X by 45 degrees from the direction Y parallel to the strip conductor 12, that is, the direction of the arrow 23 in FIG. 3.

Figure 7:
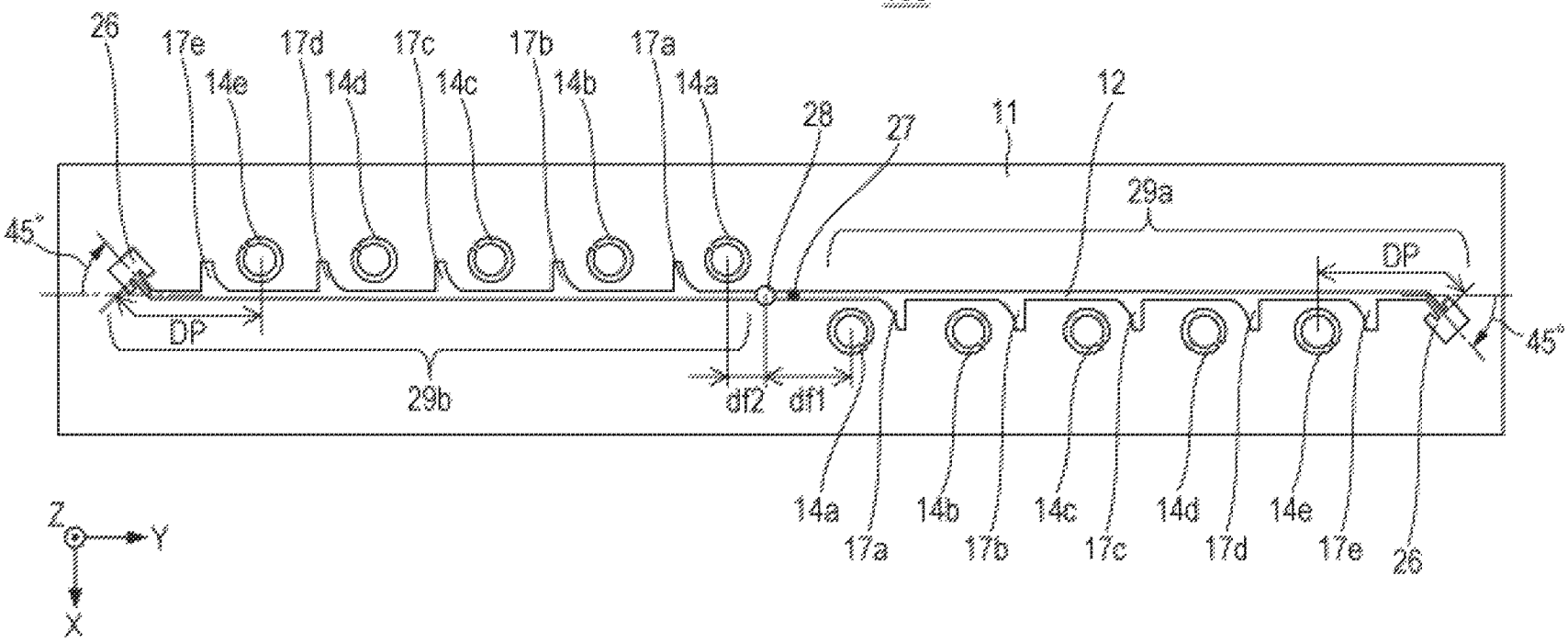
FIG. 7 is a plan view of another array antenna device according to Embodiment 1 of the present disclosure.

A spacing between the power feeder 28 and the loop element closest to the power feeder 28 in the first subarray 29*a*, which is the loop element 14*a* in FIG. 7, and a spacing between the power feeder 28 and the loop element closest to the power feeder 28 in the second subarray 29*b*, which is also the loop element 14*a* in FIG. 7, are referred to as a spacing df1 and a spacing df2, respectively. When a difference between the spacings df1 and df2 (|df1−df2|) is expressed by N×λg/2, where N represents an integer equal to or more than 1, the first subarray 29*a* and the second subarray 29*b* undergo excitation in phase. Each of the spacings D among the loop elements 14*a* to 14*e* (see FIG. 2B), a spacing DP between the loop element closest to the patch antenna 26 in the first subarray 29*a*, which is the loop element 14*e* in FIG. 7, and the patch antenna 26, and a spacing DP between the loop element closest to the patch antenna 26 in the second subarray 29*b*, which is also the loop element 14*e* in FIG. 7, and the patch antenna 26 are λg, all of the elements undergo excitation in phase.

Described below is the relation between the coupling amounts of the loop elements 14*a* to 14*e* and the patch antennas 26 in the array antenna device 100 illustrated in FIG. 7, each of which is hereinafter referred to as the "antenna element" when necessary, and the radiation pattern of the array antenna device 100.

Figure 8:
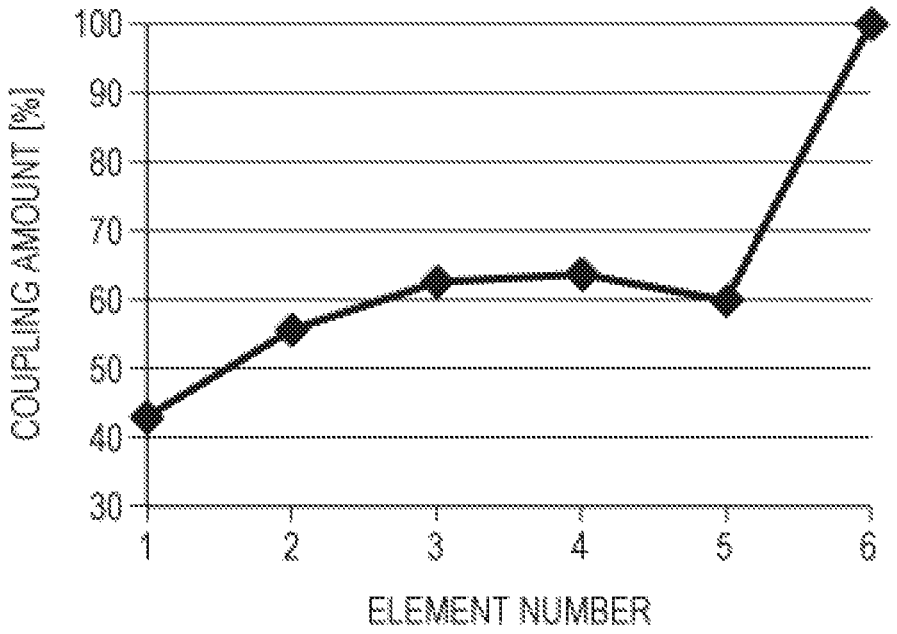
FIG. 8 illustrates an example of the coupling amount of each antenna element in the array antenna device in FIG. 7.

FIG. 8 illustrates an example of the coupling amount of each antenna element in the array antenna device 100. In FIG. 8, the lateral axis indicates the element number. The antenna elements are numbered from one to six from the antenna element that is the closest to the power feeder 28 in FIG. 7, and the patch antenna 26 corresponds to element number 6. Thus, the coupling amount of element number 6 is 100%. In FIG. 8, the longitudinal axis indicates the coupling amount of each element number on a percentage basis while the amount of element number 6 is assumed to be 100%.

Figure 9:
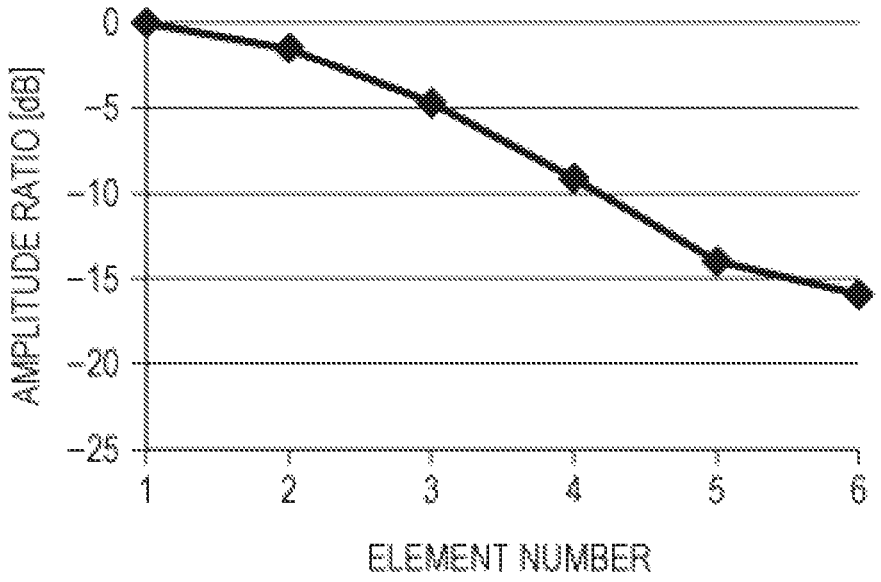
FIG. 9 illustrates the amplitude value of each antenna element, which is calculated from the coupling amount of each antenna element plotted in FIG. 8.
Figure 10:
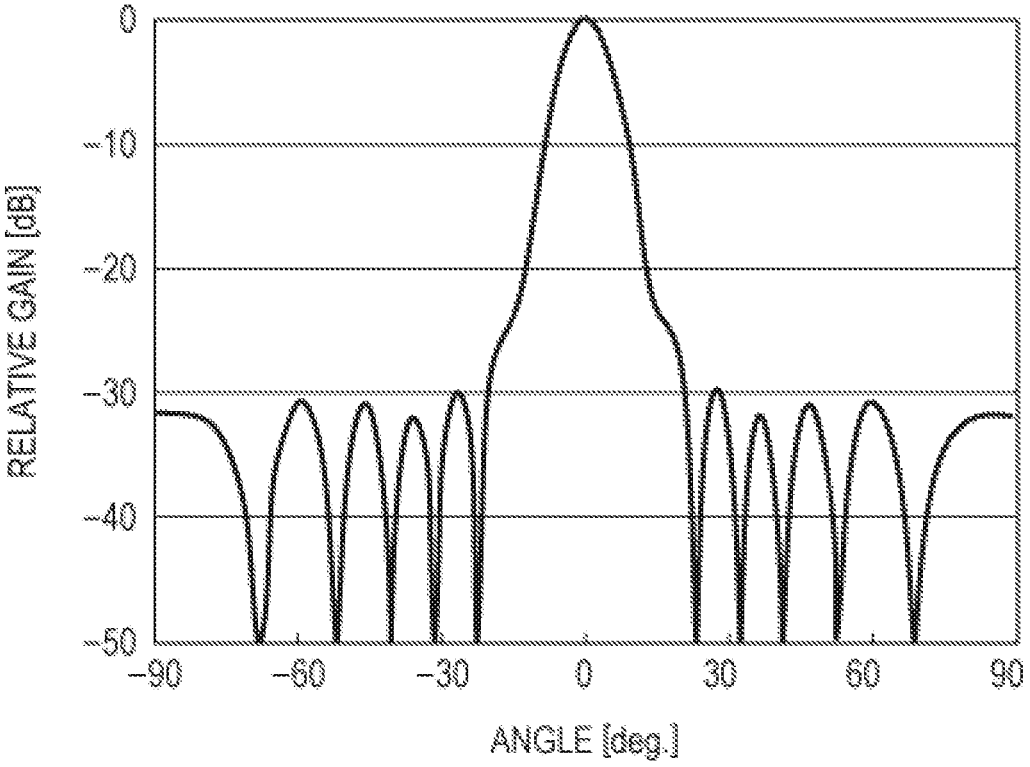
FIG. 10 illustrates a radiation pattern in the long-length direction of the array antenna device in FIG. 7, which is calculated from the amplitude values in FIG. 9.

FIG. 9 illustrates the amplitude value of each antenna element, which is calculated from the coupling amount of each antenna element plotted in FIG. 8, and FIG. 10 illustrates a radiation pattern in the long-length direction, that is, of the YZ surface of the array antenna device 100, which is calculated from the amplitude values in FIG. 9. The amplitude values in FIG. 9 are indicated as the amplitude ratios normalized at the maximum values, and in FIG. 10, the lateral axis indicates the radiation angle of radio waves and the longitudinal axis indicates the radiation amount of the radio waves in relative gain.

As described above, according to Embodiment 1, the coupling amount of each loop element can be controlled in a wide range of approximately 5% to 70% and thus, the coupling amounts illustrated in FIG. 8 can be achieved. Accordingly, Taylor distribution illustrated in FIG. 9 can be achieved and the radiation pattern illustrated in FIG. 10, where side lobes are suppressed, can be obtained. In addition, the first subarray and the second subarray illustrated in FIG. 7 have a point symmetry configuration. Thus, an array antenna device with the number of elements that is twice as many as the number of elements included in the first subarray can be designed while easily enabling the array antenna device to have high gain.

Described below is a method of suppressing side lobes when a plurality of array antenna devices, each of which is the array antenna device described with reference to FIG. 7, are arranged in the short-length direction of the strip conductor 12, that is, the direction X.

Figure 11:
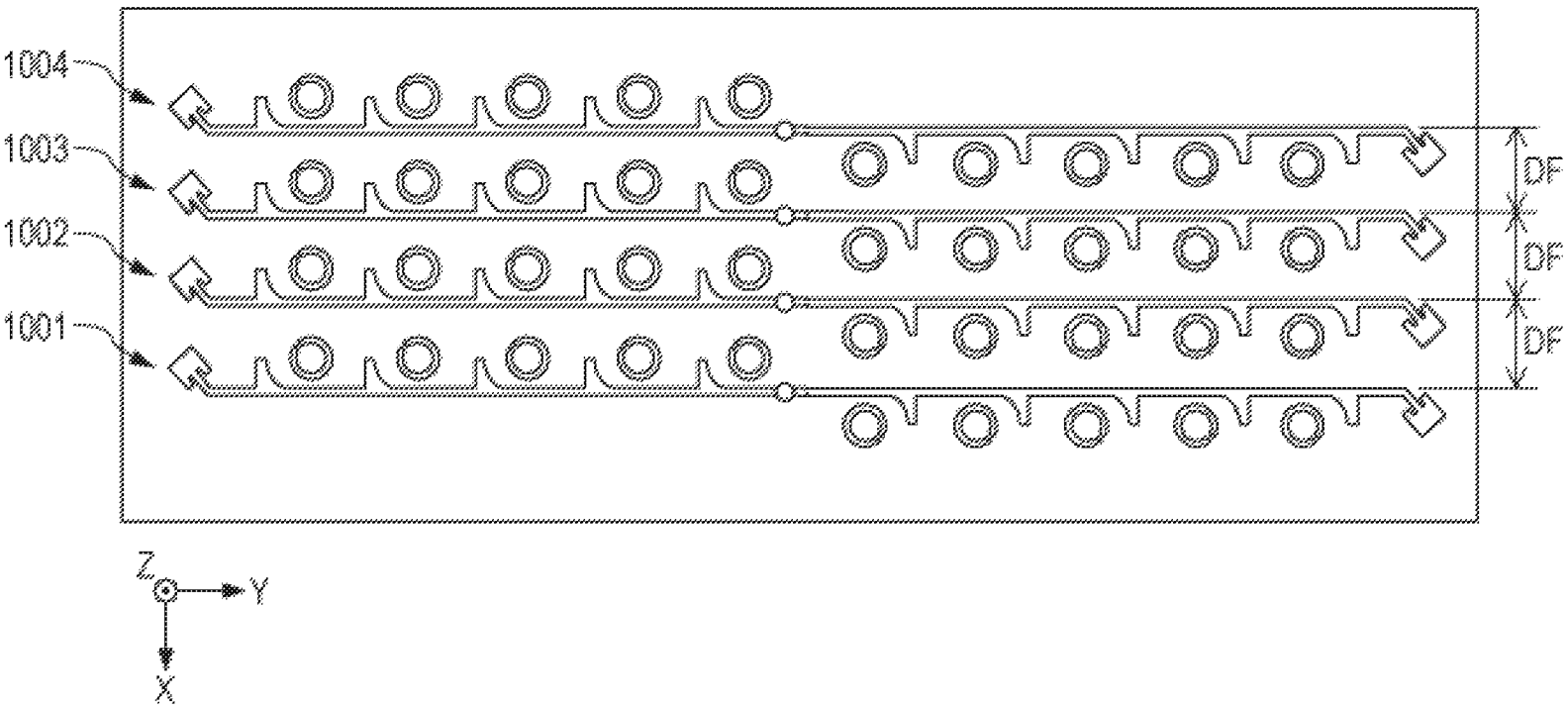
FIG. 11 illustrates an example of a configuration in which array antenna devices are arranged in four rows in the short-length direction of a strip conductor.

FIG. 11 illustrates an example of a configuration in which array antenna devices 1001 to 1004 are arranged in four rows in the short-length direction of the strip conductor 12, that is, the direction X. Each of the array antenna devices 1001 to 1004 has a configuration similar to the configuration of the array antenna device 100 illustrated in FIG. 7 and are arranged at spacings DF.

Figure 12:
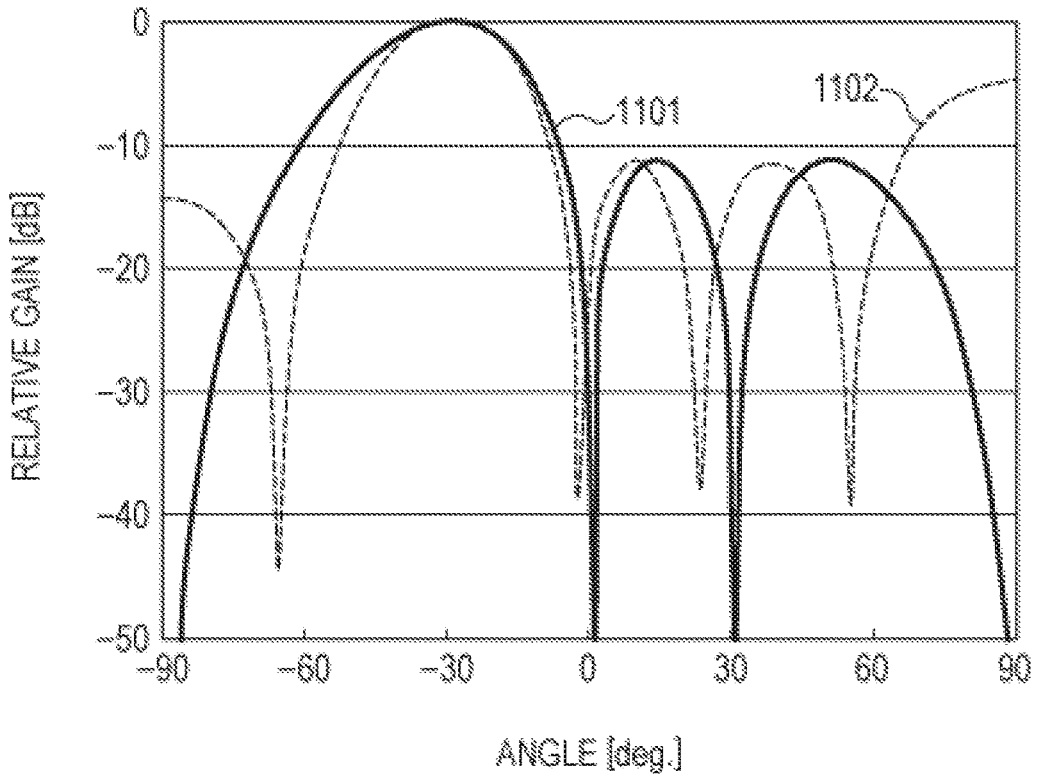
FIG. 12 illustrates radiation patterns over a certain surface, which are obtained when predetermined spacings are changed in the configuration in FIG. 11.

FIG. 12 illustrates radiation patterns of the XZ surface, which are obtained when the spacing DF between the array antenna devices, that is, among the strip conductors is changed in the configuration in FIG. 11. The radiation pattern in FIG. 12 is obtained when the amplitude values of the antenna elements included in the array antenna devices 1001 to 1004 are respectively set to the corresponding amplitude values plotted in FIG. 9.

In FIG. 12, a solid line 1101 indicates the radiation pattern obtained when the spacing DF is 0.5λ, and a broken line 1102 indicates the radiation pattern obtained when the spacing DF is 0.58λ. In FIG. 12, the lateral axis indicates the radiation angle and the longitudinal axis indicates the radiation amount of radio waves in relative gain. A phase difference that causes the beam direction of each radiation pattern to be −30 degrees is given between the rows. Specifically, the phase difference between the rows is 90 degrees when the spacing DF is 0.5λ, and the phase difference between the rows is 100 degrees when the spacing DF is 0.58λ. The array antennas in each row undergo excitation with the same amplitude.

FIG. 12 demonstrates that, in the direction of angles of 70 to 90 degrees, a side lobe is decreased in the radiation pattern of the solid line 1101, which is obtained when the spacing DF is 0.5λ, compared to the radiation pattern of the broken line 1102, which is obtained when the spacing DF is 0.58λ. It is generally known that grating lobes occur more easily and side lobes increase as an array spacing in an array antenna, which equals a row spacing in this case, is larger. That is, side lobes of the array antenna illustrated in FIG. 11 can be reduced by decreasing the spacing DF in the short-length direction of the strip conductor 12, that is, the direction X.

In Embodiment 1, a loop element that can ensure the length of ½ wavelength on an arc is used and the spacing DF can be decreased accordingly.

[Variation of Point Symmetry Configuration]

Although Embodiment 1 describes the array antenna device 100 illustrated in FIG. 7 as an example of the point symmetry configuration, the configuration of the point symmetry is not limited to FIG. 7 and may employ various configurations.

Figure 13:
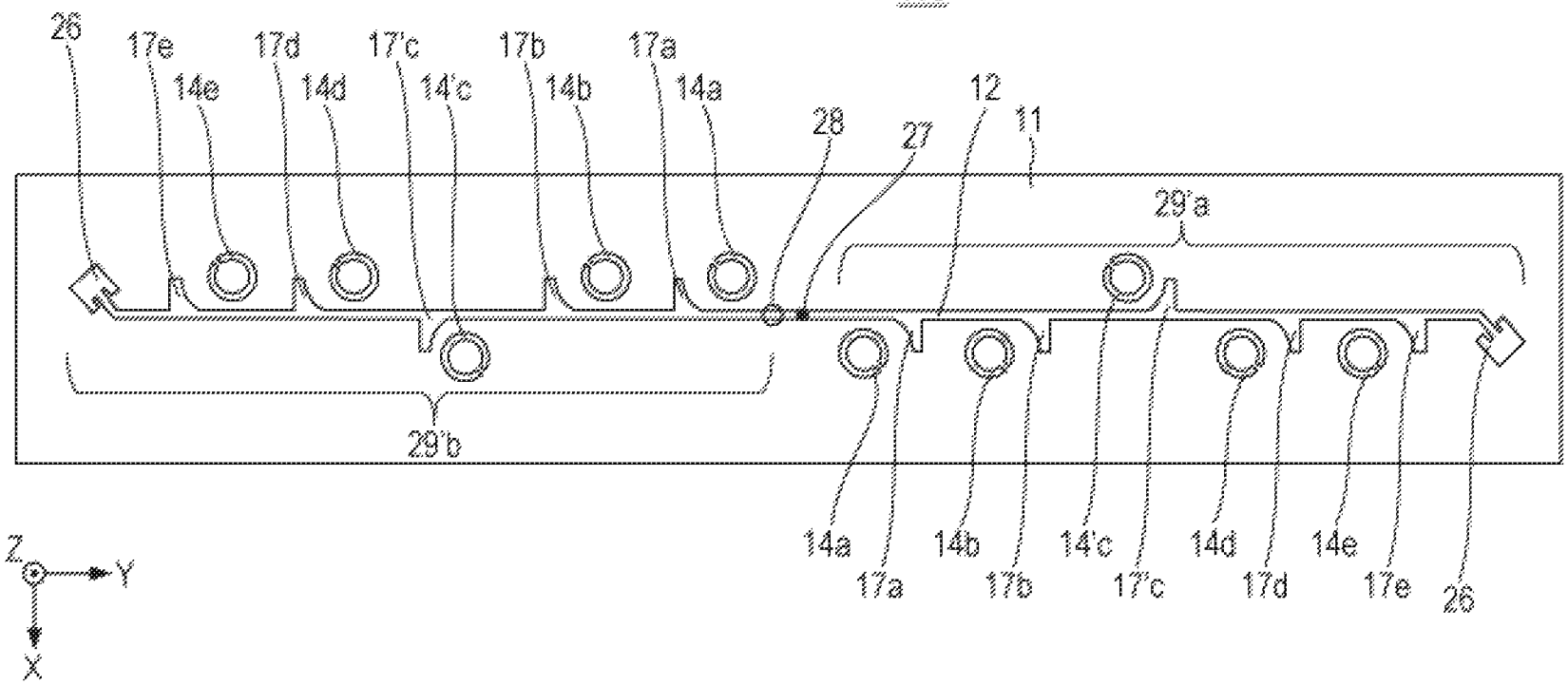
FIG. 13 is a plan view illustrating another variation of the array antenna device according to Embodiment 1 of the present disclosure.

FIG. 13 is a plan view illustrating an array antenna device 100' according to Embodiment 1 of the present disclosure. In the array antenna device 100' illustrated in FIG. 13, one of the loop elements, 14*c*, and one of the feeding elements, 17*c*, in the array antenna device 100 illustrated in FIG. 7 are replaced with a loop element 14'*c* and a feeding element 17'*c*, respectively.

Also in the array antenna device 100' illustrated in FIG. 13, a first subarray 29'*a* and a second subarray 29'*b* are arranged so as to have point symmetry in which the antenna central point 27 is positioned at the center. The configuration in FIG. 13 can bring characteristics similar to those brought by the array antenna device 100 illustrated in FIG. 7.

[Variation of Antenna Element at Terminal End]

Embodiment 1 above describes the configuration in which the patch antenna 26 is provided as a microstrip antenna element at an end portion of each subarray, which is opposite the end portion at which the power feeder is provided, as illustrated in FIG. 7. However, the antenna element provided at the end portion of the subarray is not limited thereto.

Figure 14:
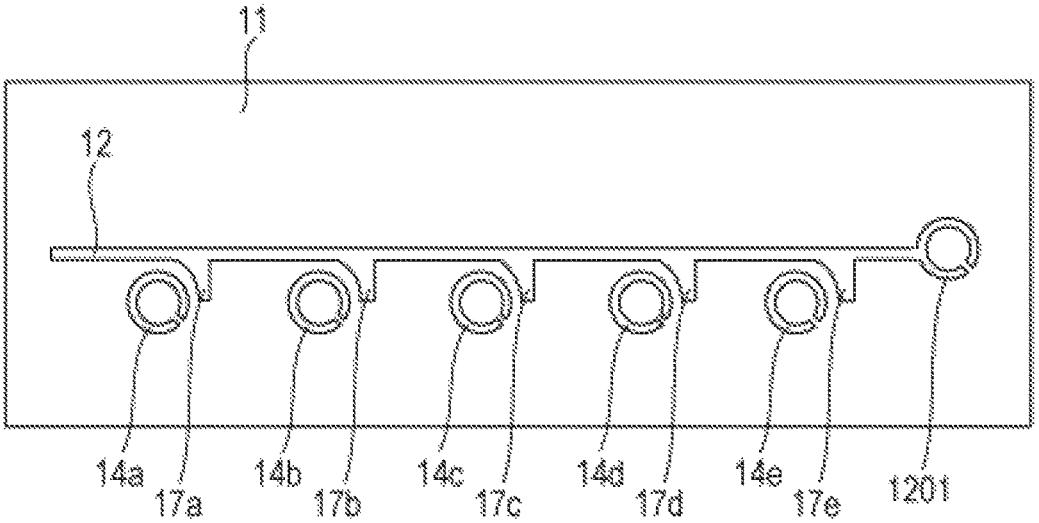
FIG. 14 illustrates an example of another configuration of a subarray in FIG. 7.

FIG. 14 illustrates an example of another configuration of the subarray in FIG. 7. In the subarray illustrated in FIG. 14, the patch antenna 26 provided at the terminal end of the subarray in FIG. 7 is replaced with a loop antenna 1201. Also when the loop antenna 1201 is provided at the terminal end of the subarray as illustrated in FIG. 14, a radiation pattern similar to the radiation pattern of the case that employs the patch antenna 26 can be obtained. Furthermore, since the loop antenna 1201 is an antenna element having a configuration the same as those of the loop elements 14*a* to 14*e*, the array antenna device can be designed easily as a whole.

[Variation of Shape of Feeding Element]

In the shape of each of the feeding elements 17*a* to 17*e* described above in Embodiment 1, one side of the connection portion between the strip conductor 12 and each of the feeding elements 17*a* to 17*e* is perpendicular. Described below is another variation in which the connection portion between the strip conductor 12 and the feeding element is not perpendicular.

Figure 15:
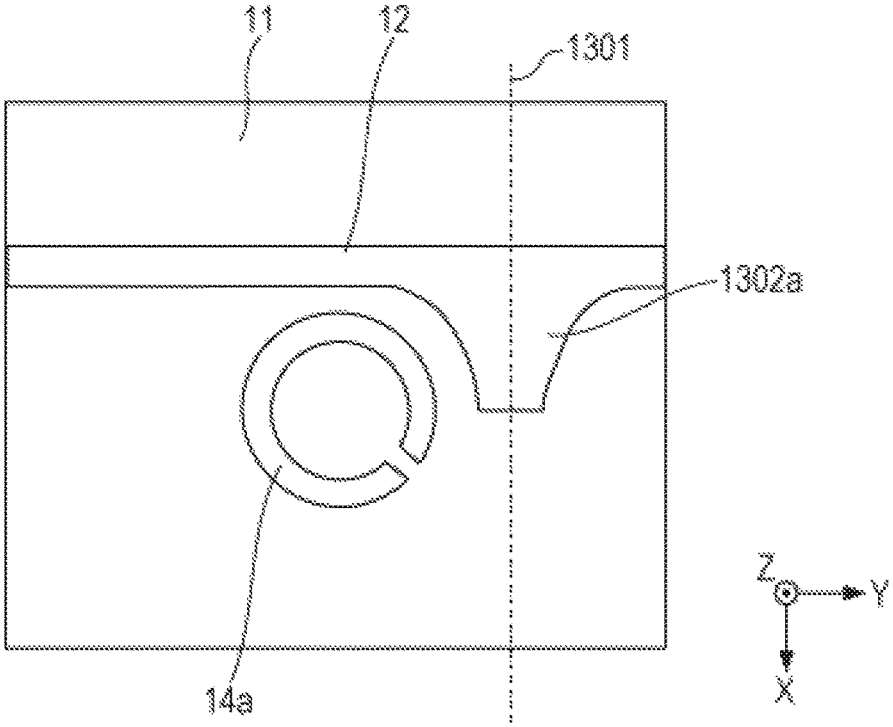
FIG. 15 illustrates an example of another configuration of the feeding element.

FIG. 15 illustrates an example of another configuration of the feeding element 17*a*. In the configuration illustrated in FIG. 15, the above-described feeding element 17*a* corresponding to the loop element 14*a* in FIGS. 2A to 2C is replaced with a feeding element 1302*a*. The feeding element 1302*a* has line symmetry with respect to a broken line 1301, and no perpendicular shape is included in the portion that connects to the strip conductor 12 on the left or right side. That is, when the configuration of the feeding element 1302*a* illustrated in FIG. 15 is employed, a portion perpendicular to the strip conductor 12 is not present in the pattern shape of the connection portion between the strip conductor 12 and the feeding element 1302*a*.

Typically, when, in a portion where current is concentrated, such as a power feeder of an antenna, the line pattern of the substrate 11, that is, the pattern of the strip conductor, the feeding element, the antenna element, and the like, includes a perpendicular portion, unintended strong radio waves can be radiated in the perpendicular portion included in the line pattern. When the radiation of such unintended strong radio waves occurs, the radio waves radiated from the antenna element may be unstable, the shape of the radiation pattern may change, and the magnitude of the cross polarization may increase.

Thus, for example, a favorable radiation pattern with low cross polarization can be obtained by causing the shape of the feeding element to include no perpendicular portion as illustrated in FIG. 15. Although FIG. 15 illustrates the feeding element 1302*a* with line symmetry, the shape is not limited to the line symmetry and as long as the line pattern in the configuration includes no perpendicular portion, similar to FIG. 15, a favorable radiation pattern with low cross polarization can be obtained.

The above-described variations of the configuration may be combined. For example, the patch antenna 26 at the terminal end portion of the array antenna device 100' illustrated in FIG. 13 may be replaced with the loop antenna 1201. As another example, one or all of the feeding elements 17*a* to 17*e* illustrated in FIG. 13 may be caused to have a shape similar to the shape of the feeding element 1302*a* illustrated in FIG. 15.

Embodiment 2

Embodiment 2 of the present disclosure is described in detail below with reference to the drawings. Each embodiment described below is an example, which is not intended to limit the present disclosure.

Circumstances Underlying Embodiment 2

The circumstances underlying Embodiment 2 are now described. Specifically, a configuration that comes into focus in the present disclosure when an array antenna device is used in a radar device mounted in a vehicle is described.

A first focused point is described below.

Typically, radio waves radiated from a directional antenna, such as an array antenna, include a main lobe in a desired direction and a side lobe in a direction shifted from the desired direction.

To detect an object in the desired direction, the radar device mounted in the vehicle orients the main lobe in the desired direction. When the radar device radiates radio waves including a significant side lobe, however, incorrect detection indicating that the object would be present in the desired direction may be caused by the side lobe even if the object is not present in the desired direction.

A second focused point is described next.

It is assumed that the radar device is mounted in each of a vehicle A, which is traveling on a road surface, and a vehicle B, which is traveling on the opposite lane of the vehicle A in the direction opposite the direction in which the vehicle A is traveling. When the polarized-wave direction of the radio waves radiated from each radar device is perpendicular to the road surface, the radio waves radiated from each radar device interfere with each other, and as a result, the interference causes incorrect detection. In contrast, when the polarized-wave direction of the radio waves radiated from each radar device is in a 45-degree direction relative to the road surface, the polarized-wave direction of the radio waves radiated from the vehicle A and the polarized-wave direction of the radio waves radiated from the vehicle B are perpendicular to each other and the interference is thus suppressed.

However, even when the direction of the main polarized waves of the radio waves radiated from the radar device of the vehicle A and the direction of the main polarized waves of the radio waves radiated from the radar device of the vehicle B are perpendicular to each other, the direction of the cross polarization of the radio waves radiated from the radar device of the vehicle A agrees with the direction of the main polarized waves of the vehicle B. Accordingly, the cross polarization of the radio waves radiated from the radar device of the vehicle A and the main polarized waves of the radio waves radiated from the radar device of the vehicle B interfere with each other. When the interference is large, incorrect detection of the radar device may be caused.

Thus, as a result of assiduous studies in view of the above-described issues, the present inventors have found that modifying the shape and the feeding configuration of an antenna element can lead to suppression of side lobes of radio waves radiated by an array antenna device and reduction in the cross polarization ratio, and have reached the present disclosure.

Figure 16:
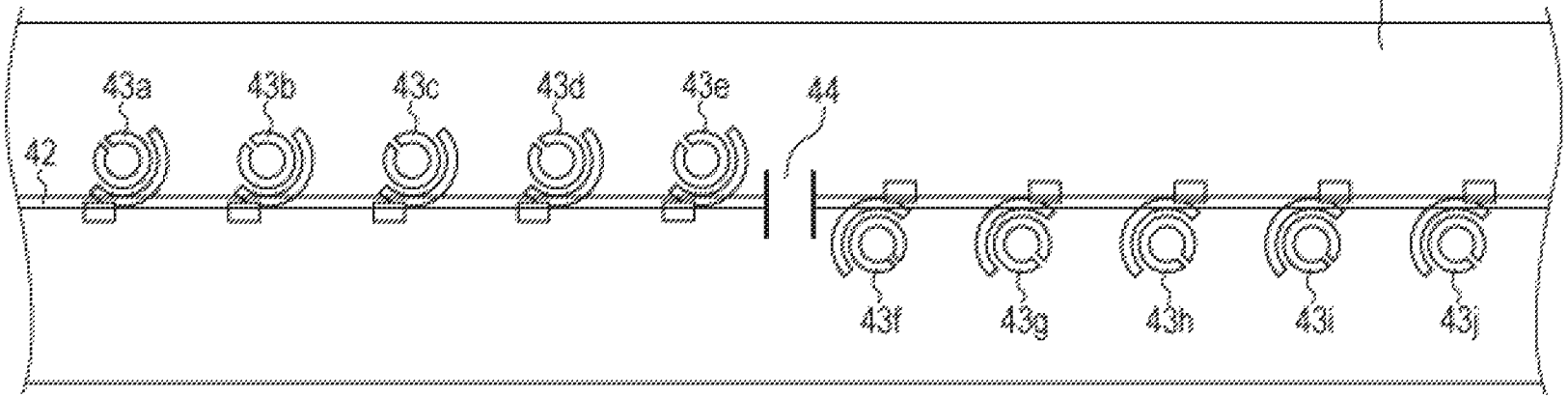
FIG. 16 illustrates an example of an array antenna device according to Embodiment 2 of the present disclosure.

FIG. 16 illustrates an example of an array antenna device 40 according to Embodiment 2 of the present disclosure. The array antenna device 40 illustrated in FIG. 16 includes a substrate 41, a feeding line 42, a plurality of antenna elements 43*a* to 43*j*, and a feeding point 44. The feeding line 42 corresponds to the strip conductor in Embodiment 1.

The substrate 41 is, for example, a double-sided copper-clad substrate. The feeding line 42 is formed by a copper foil pattern or the like on one surface of the substrate 41. The feeding line 42 and a conductor plate formed on another surface of the substrate 41, which is not illustrated, constitute a microstrip line or a strip conductor.

The plurality of antenna elements 43*a* to 43*j* are arranged on the surface of the substrate 41 on which the feeding line 42 is formed at predetermined spacings along the feeding line 42. It is not necessarily required that all the predetermined spacings among the plurality of antenna elements 43*a* to 43*j* be identical and a different spacing may be included. The feeding point 44 is a feeding position for the array antenna device 40. The current fed from the feeding point 44 flows through the feeding line 42 and is supplied to each of the antenna elements 43*a* to 43*j* from the feeding line 42.

Each of the antenna elements 43*a* to 43*j* to which the current is supplied radiates an adjusted amount of radio waves.

Described below are the configurations of the antenna elements 43*a* to 43*j* by taking the antenna element 43*a* as an example. Each of the other antenna elements 43*b* to 43*j* has a configuration similar to the configuration of the antenna element 43*a*.

Figure 17:
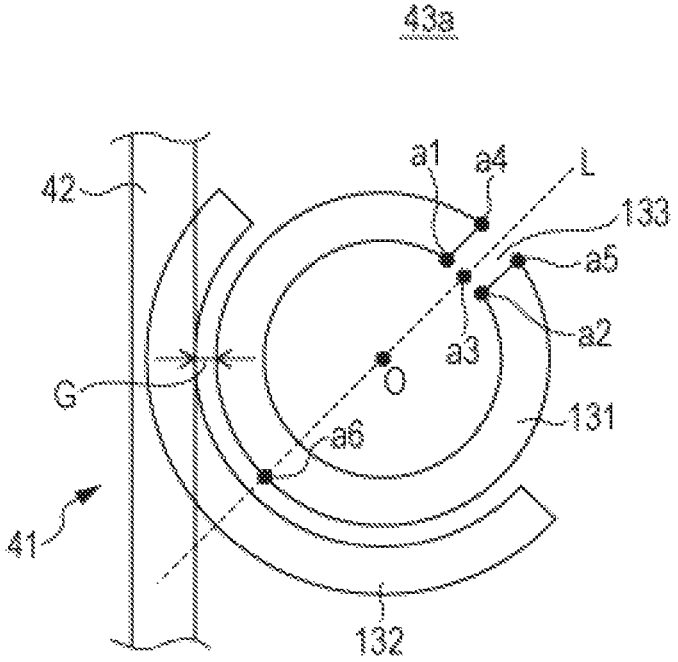
FIG. 17 illustrates an example of a configuration of an antenna element according to Embodiment 2 of the present disclosure.

FIG. 17 illustrates an example of the configuration of the antenna element 43*a* according to Embodiment 2 of the present disclosure. The antenna element 43*a* illustrated in FIG. 17 is made up of a loop element 131 and a feeding element 132.

The loop element 131 has a shape like a circular ring, in part of which a notch portion 133 is provided. The length of the outer edge of the loop element 131 constitutes approximately one wavelength of radio waves radiated. The notch portion 133 is provided at a position at which the angle between a straight line L, which connects a center O of the loop element 131 and an approximate center of the notch portion 133, and the long-length direction of the feeding line 42 is 45 degrees.

More specifically, as illustrated in FIG. 17, the approximate center of the notch portion 133 is a middle point a3 of a line segment that connects end points a1 and a2 on the inner edge side of the notch portion 133. That is, the notch portion 133 is provided at the position at which the angle between the straight line L, which connects the center O of the loop element 131 and the middle point a3, and the long-length direction of the feeding line 42 is 45 degrees.

When end points on the outer edge side of the notch portion 133 are referred to as points a4 and a5, and a point at which the straight line L and the outer edge of the loop element 131 meet is referred to as an intersection point a6, on the outer edge side of the loop element 131, the length from the point a4 to the intersection point a6 and the length from the point a5 to the intersection point a6 are approximately identical and each length is approximately ½ wavelength.

The feeding element 132 is provided at a position apart from the outer edge of the loop element 131 by a predetermined spacing G so as to be approximately parallel to the loop element 131 and has a shape like a semicircular ring. The feeding element 132 is electromagnetically coupled with the loop element 131 apart by the predetermined spacing G.

The loop element 131 and the feeding element 132 are shaped so as to have line symmetry with respect to the straight line L.

The feeding element 132 is connected to the feeding line 42 and fed from the feeding line 42. The current that flows into the feeding element 132 is supplied to the loop element 131 apart by the predetermined spacing G through the electromagnetic coupling. The loop element 131 is supplied with the current because of the electromagnetic coupling with the feeding element 132.

Thus, the loop element 131 can ensure the length of ½ wavelength on an arc rather than on a straight line. Accordingly, the antenna element 43*a* can be downsized and the length in the short-length direction of the feeding line 42 can be reduced.

Moreover, since the notch portion 133 is provided in the 45-degree direction relative to the feeding line 42, the loop element 131 enables radio waves whose polarized-wave direction is diagonally at an angle of 45 degrees to be radiated in a direction perpendicular to the substrate 41.

When the loop element 131 and the feeding element 132 are shaped so as to have line symmetry with respect to the straight line L, the cross polarization ratio of the radio waves radiated from the loop element 131 is decreased. The principle of decreasing the cross polarization is described below.

The amount of the radio waves radiated from the loop element 131, that is, the field intensity, is controlled on the basis of the coupling amount of the electromagnetic coupling between the loop element 131 and the feeding element 132. The coupling amount is controlled by adjusting the spacing G between the loop element 131 and the feeding element 132.

Figure 18:
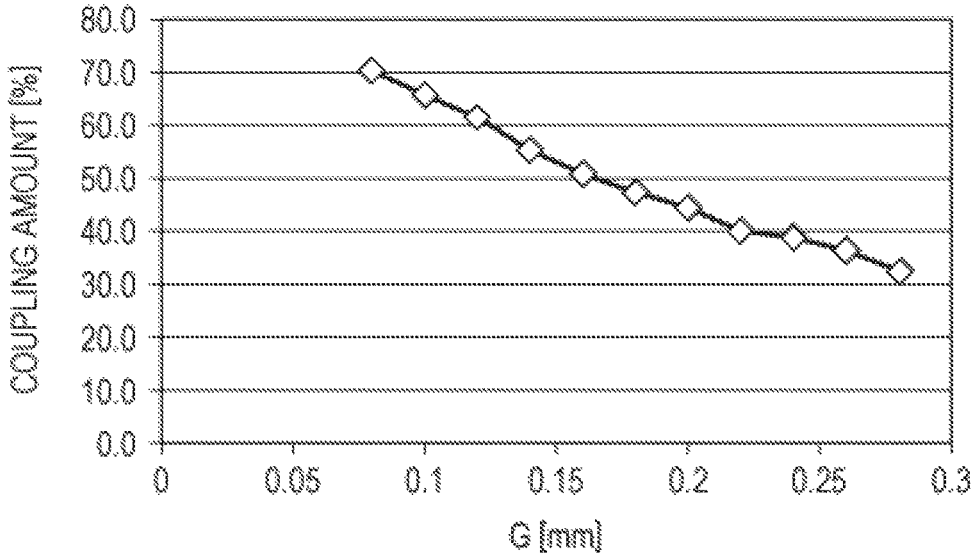
FIG. 18 illustrates relation between a predetermined spacing, which is provided between the loop element and the feeding element, and the coupling amount.

A specific relation between the spacing G and the coupling amount is now described. FIG. 18 illustrates the relation between the spacing G, which is provided between the loop element 131 and the feeding element 132, and the coupling amount. In FIG. 18, the lateral axis indicates the length of the spacing G and the longitudinal axis indicates the coupling amount.

As illustrated in FIG. 18, the coupling amount can be controlled in a wide range of approximately 25% to 70% by adjusting the spacing G between the antenna element and the feeding element.

Described below is the relation between the coupling amount of each antenna element and the radiation pattern of an array antenna device.

Figure 19:
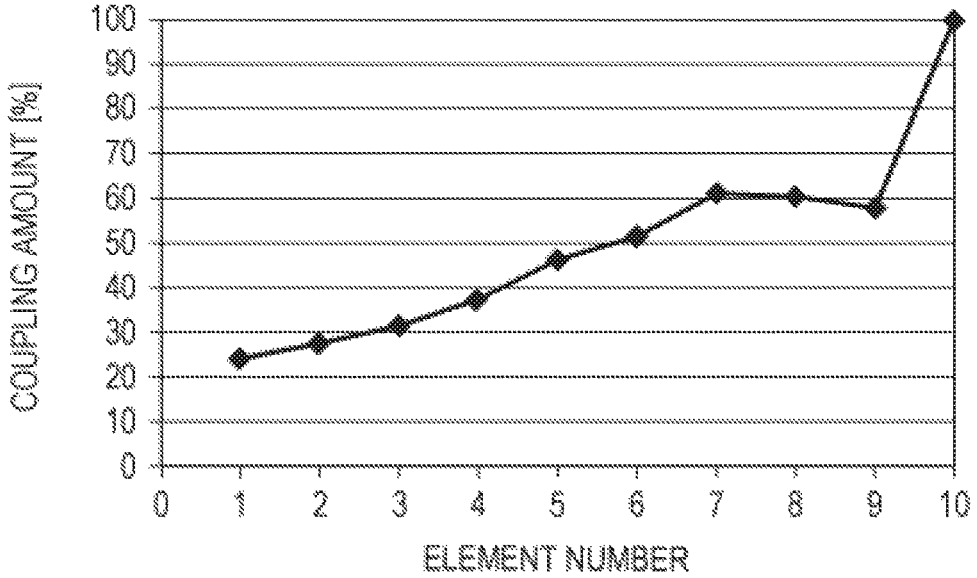
FIG. 19 illustrates an example of the coupling amount of each antenna element in an array antenna device.

FIG. 19 illustrates an example of the coupling amount of each antenna element in an array antenna device. In FIG. 19, the horizontal axis indicates the element number and the vertical axis indicates the coupling amount. The array antenna device corresponding to the example in FIG. 19, includes nine antenna elements on each of the left side and right side, such as the antenna elements 43*a* to 43*j* illustrated in FIG. 16 and other antenna elements that are not illustrated in FIG. 16, while a feeding point is positioned at the center, and patch elements, not illustrated, are arranged at positions farthest from the feeding point. The nine antenna elements on each side are numbered from one to nine from the antenna element closest to the feeding point and the patch element corresponds to element number 10.

Figure 20:
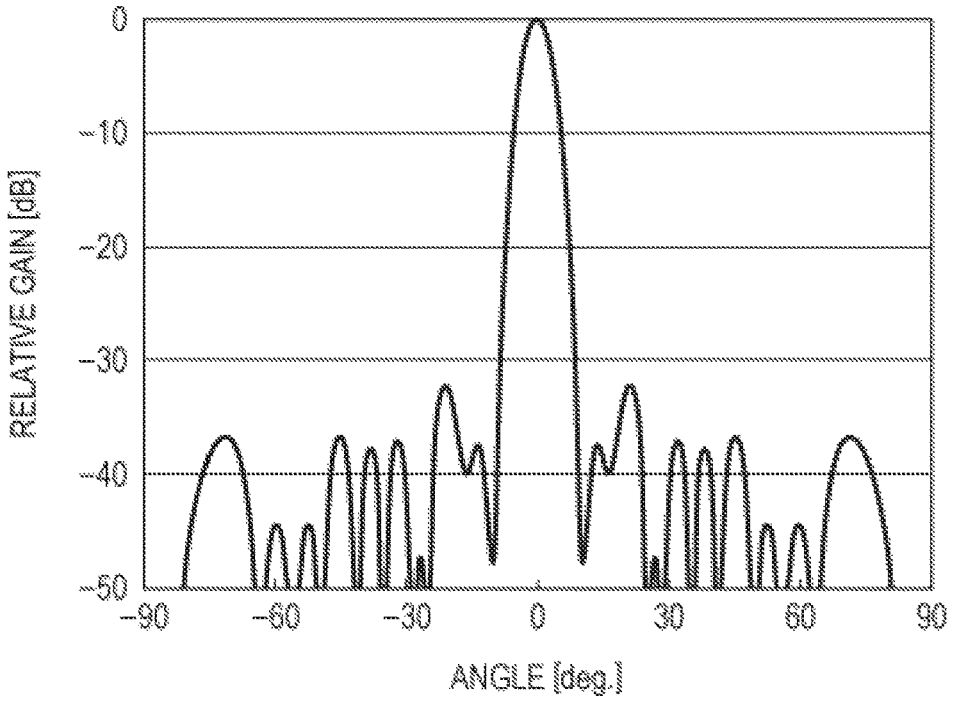
FIG. 20 illustrates a radiation pattern in the long-length direction of the array antenna device, which is calculated from the coupling amount of each antenna element illustrated in FIG. 19.

FIG. 20 illustrates the radiation pattern in the long-length direction of the array antenna device, which is calculated from the coupling amount of each antenna element illustrated in FIG. 19. In FIG. 20, the lateral axis indicates the radiation angle and the longitudinal axis indicates the gain of each radiation angle in a value relative to the maximum gain.

As described above, according to the present disclosure, the coupling amount of each antenna element can be controlled in a wide range of approximately 25% to 70% and thus, the radiation pattern illustrated in FIG. 20, where side lobes are suppressed, can be obtained by performing control so that the coupling amounts of the antenna elements with the smaller element numbers are lower.

Described below is a method of suppressing side lobes when a plurality of array antenna devices, each of which is the array antenna device described with reference to FIG. 16, are arranged in the short-length direction of the feeding line.

When for example, four array antenna devices, each of which is the array antenna device described with reference to FIG. 16, are arranged in the short-length direction of the feeding line at spacings D, the radiation pattern caused by the four arranged array antenna devices varies, depending on the spacings D.

Figure 21:
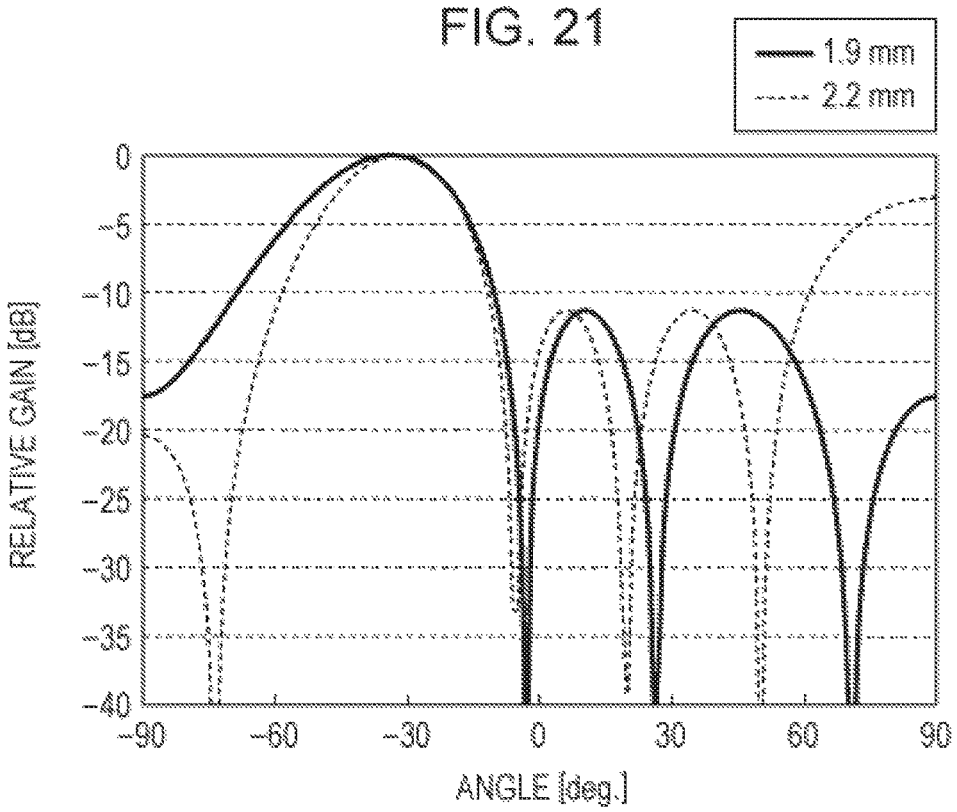
FIG. 21 illustrates radiation patterns obtained when four array antenna devices are arranged in the short-length direction of a feeding line at predetermined spacings.

FIG. 21 illustrates radiation patterns obtained when the four array antenna devices are arranged in the short-length direction of the feeding line at the spacings D. In FIG. 21, the lateral axis indicates the radiation angle and the longitudinal axis indicates the gain of each radiation angle in a value relative to the maximum gain. In FIG. 21, the radiation pattern obtained when the spacing D is 1.9 mm is indicated by a solid line and the radiation pattern obtained when the spacing D is 2.2 mm is indicated by a broken line.

As illustrated in FIG. 21, a side lobe is increased in the radiation pattern obtained when the spacing D is 2.2 mm, compared to the radiation pattern obtained when the spacing D is 1.9 mm. That is, when the array antenna devices are arranged in the short-length direction of the feeding line, the spacing D needs to be made small.

According to Embodiment 2, the loop element 131 that can ensure the length of ½ wavelength on an arc is used and thus, the spacing D can be shortened.

As described above, according to the present disclosure, the spacing in the short-length direction of the array antenna device can be shortened, and when a plurality of array antenna devices are arranged in the short-length direction of the feeding line, side lobes can be suppressed by achieving downsizing of the array antenna devices.

Figure 22:
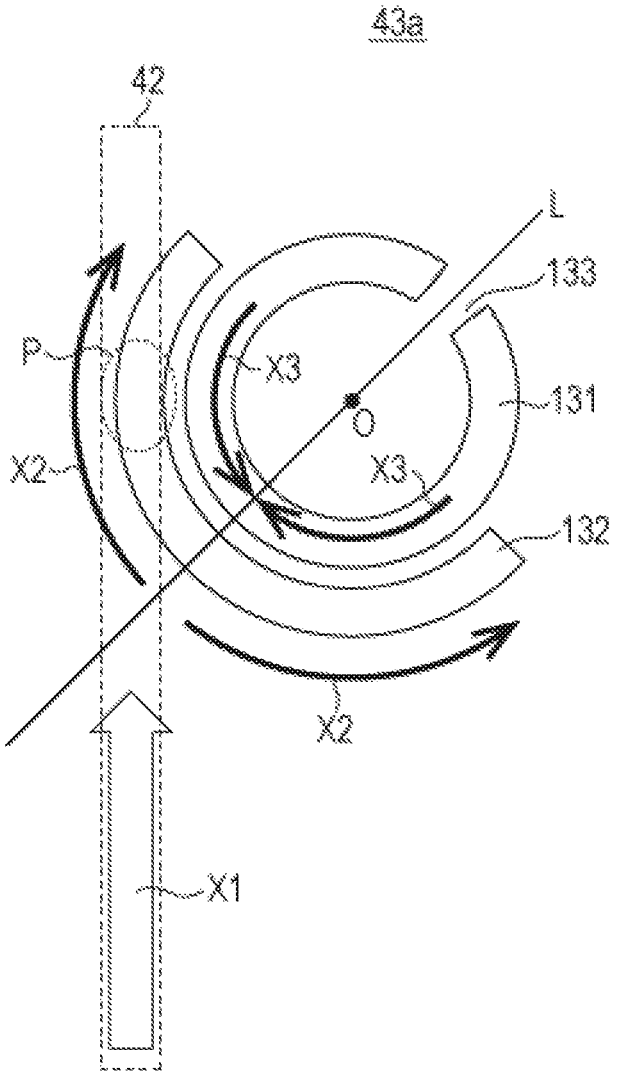
FIG. 22 is a diagram for describing the principle of radiation of radio waves according to Embodiment 2 of the present disclosure.

Described below is the principle that the shapes of the loop element 131 and the feeding element 132 enable radio waves with a low cross-polarization ratio to be radiated. FIG. 22 is a diagram for describing the principle of the radiation of radio waves according to Embodiment 2 of the present disclosure. FIG. 22 schematically illustrates the current that flows in the antenna element 43*a* illustrated in FIG. 17 and omits the feeding line 42 for convenience in describing FIG. 22.

The current supplied to the antenna element 43*a* illustrated in FIG. 22 flows in the direction of an arrow X1 through the feeding line 42 (see FIG. 17). The current that flows in the direction of the arrow X1 is supplied from a connection point P between the feeding element 132 and the feeding line 42 to the feeding element 132. In the feeding element 132, the current flows in the directions of arrows X2 and is supplied to the loop element 131 through the electromagnetic coupling.

In the loop element 131, the current flows in the directions of arrows X3. The current that flows through the loop element 131 in the directions of the arrows X3 forms a large electric field near the position where the notch portion 133 of the loop element 131 is provided, and forms a small electric field in an opposite position across the center O of the notch portion 133 of the loop element 131. When such electric fields are formed, the loop element 131 radiates radio waves whose main polarized waves are oriented in the direction of the straight line L.

As indicated by the arrows X2 and X3 in FIG. 22, the current that flows through the loop element 131 and the feeding element 132 forms line symmetry with respect to the straight line L. As a result, compared to the main polarized waves oriented in the direction of the straight line L, the cross-polarized waves oriented in the direction perpendicular to the straight line L are decreased. That is, the loop element 131 and the feeding element 132 can radiate radio waves with a low cross-polarization ratio by having shapes of line symmetry with respect to the straight line L.

Although it is described above that the feeding line 42 is directly connected to the antenna elements 43*a* to 43*j* on the surface of the substrate 41 on which the antenna elements 43*a* to 43*j* are formed, the positions of the feeding line 42 and the antenna elements 43*a* to 43*j* are not limited thereto.

Figure 23A:
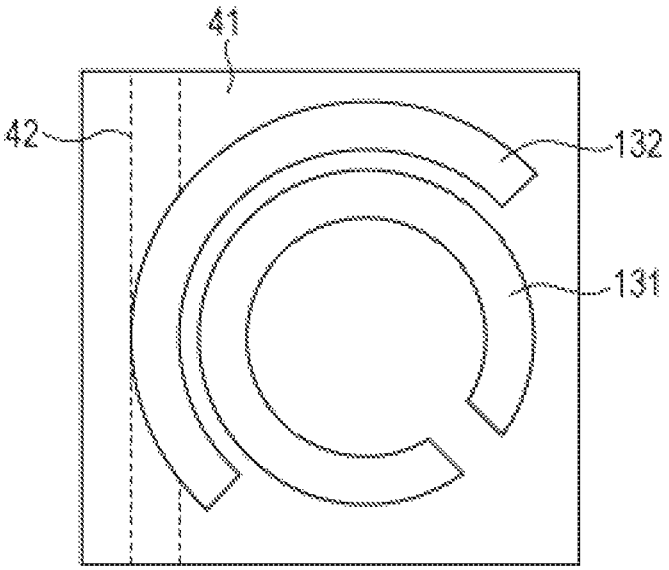
FIG. 23A illustrates an example of a variation of the position of the feeding line according to Embodiment 2 of the present disclosure and is a diagram of an antenna element viewed from above.
Figure 23B:
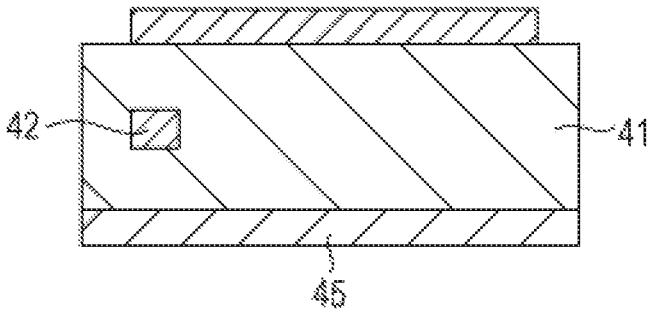
FIG. 23B illustrates an example of a variation of the position of the feeding line according to Embodiment 2 of the present disclosure and schematically illustrates a cross section of the substrate in a position where the antenna element is provided.

FIG. 23A and FIG. 23B each illustrate an example of a variation of the position of the feeding line 42 according to Embodiment 2 of the present disclosure. FIG. 23A is a diagram of the antenna element 43*a* viewed from above, and FIG. 23B schematically illustrates a cross section of the substrate 41 in the position where the antenna element 43*a* is provided.

As illustrated in FIGS. 23A and 23B, the feeding line 42 is provided inside the substrate 41. The feeding line 42 constitutes a microstrip line together with the conductor plate 45. The feeding line 42 is electromagnetically coupled with the feeding element 132 provided on one surface of the substrate 41 and supplies current to the feeding element 132.

Figure 24:
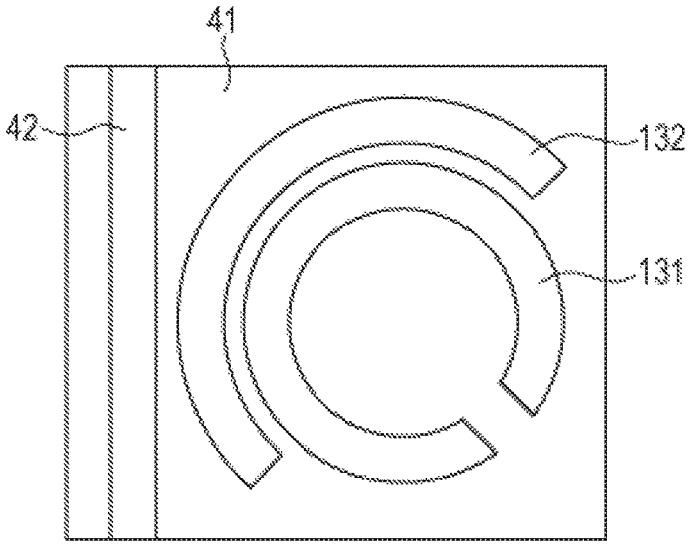
FIG. 24 illustrates another example of a variation of the position of the feeding line according to Embodiment 2 of the present disclosure.

FIG. 24 illustrates another example of a variation of the position of the feeding line 42 according to Embodiment 2 of the present disclosure. As illustrated in FIG. 24, the feeding element 132 is provided at a position apart from the feeding line 42 by a predetermined spacing. In this case, the feeding line 42 is electromagnetically coupled with the feeding element 132 and supplies current to the feeding element 132.

In each of the examples illustrated in FIGS. 23A, 23B, and 24, the feeding line 42 is electromagnetically coupled with the feeding element 132. According to these configurations, the coupling amount between the feeding line 42 and the feeding element 132 can be controlled by adjusting the position of the feeding element 132.

Figure 25:
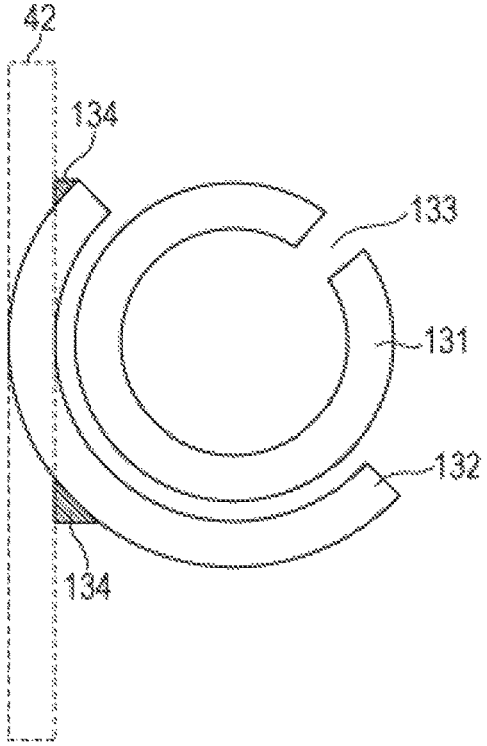
FIG. 25 illustrates an example of connection between the feeding line and the feeding element according to Embodiment 2 of the present disclosure.

FIG. 25 illustrates an example of the connection between the feeding line 42 and the feeding element 132 according to Embodiment 2 of the present disclosure. In FIG. 25, identical references are given to the elements common to those in FIG. 22 and detailed descriptions of such common elements are omitted. In FIG. 25, the feeding line 42 and the feeding element 132 are formed on the same surface of the substrate. In the configuration in FIG. 22, the connection portion between the feeding line 42 and the feeding element 132 forms an acute angle. In the configuration of FIG. 25, a line 134 is provided so as to fill portions with the acute angle formed by the connection portion.

In manufacturing a substrate, a connection portion that forms an acute angle may decrease the etching accuracy of a conductor. In the configuration of FIG. 25, the line 134 is added so as to increase the conductor etching accuracy. The addition of the line 134 enables the formation of the feeding element 132 without decreasing the conductor etching accuracy.

Although the formation of the line 134 changes the flow of the current in the feeding element 132, the suppression of cross polarization is not affected as long as the length of the portion where the line 134 is longest is equal to or less than ⅛ wavelength.

The array antenna device according to the present disclosure is suitable for use in a radar device, which is mounted in a vehicle for example.

What is claimed is:

1. An array antenna device comprising:

a substrate;

a strip conductor, having a linear-shape, which is provided on the substrate;

a power feeder that feeds power to the strip conductor;

a plurality of loop elements which are provided on a first surface of the substrate, and are located along the strip conductor with a specified spacing from each other, each of the plurality of loop elements having a loop-shape with a notch;

a conductor plate provided on a second surface of the substrate, the second surface being an opposite surface of the first surface; and a plurality of feeding elements provided on the first surface of the substrate, and connected to the strip conductor, each of the plurality of feeding elements having a shape extending along a portion of an outer edge of corresponding one of the plurality of loop elements and being separated from the corresponding one of the plurality of loop elements, wherein the plurality of loop elements include a first set of loop elements and a second set of loop elements, the first set of loop elements being located along a first side of a first contiguous portion of the strip conductor, and the second set of loop elements being located along a second side, opposite to the first side, of a second contiguous portion of the strip conductor.

2. The array antenna device according to claim 1, wherein the notch of each of the plurality of loop elements is provided in a 45-degree direction relative to a linear direction of the strip conductor.

3. The array antenna device according to claim 1, wherein the plurality of loop elements are located to be point symmetry with respect to a central point of the strip conductor, and the plurality of feeding elements are located to be point symmetry with respect to the central point of the strip conductor.

4. The array antenna device according to claim 1, wherein the strip conductor includes a termination element at a terminal end of the strip conductor.

5. The array antenna device according to claim 4, wherein the termination element is another loop element.

6. The array antenna device according to claim 1, wherein each of the plurality of feeding elements has a semicircular ring shape and is provided at an outside of the outer edge of corresponding one of the plurality of loop elements with a spacing from the corresponding one of the plurality of loop element, the spacing being predetermined.

7. The array antenna device according to claim 1, wherein a spacing between each of the plurality of loop elements and corresponding one of the plurality of feeding elements is individually adjusted on a loop-element basis.

8. The array antenna device according to claim 1, wherein each of the plurality of loop elements and corresponding one of the plurality of feeding elements are shaped to be line symmetry with respect to a straight line connecting a center of the notch and a center of respective loop element.

9. The array antenna device according to claim 1, wherein each of the plurality of feeding elements is electromagnetically coupled with the strip conductor.

10. The array antenna device according to claim 1, wherein the strip conductor is provided inside the substrate.

11. The array antenna device according to claim 1, wherein the strip conductor is provided on the first surface of the substrate.

12. The array antenna device according to claim 1, wherein the strip conductor is provided on the first surface of the substrate, and each of the plurality of feeding elements is directly connected to the strip conductor.

13. The array antenna device according to claim 1, wherein the plurality of notches of the respective plurality of loop elements are located to have point symmetry with respect to a central point of the strip conductor.

14. The array antenna device according to claim 1, wherein each of the plurality of feeding elements has a semicircular ring shape and is provided at a side opposite the notch of a straight line on the first surface perpendicular to a straight line connecting a center of the notch and a center of respective loop element.

15. The array antenna device according to claim 1, wherein a height of each of the plurality of feeding elements in a direction perpendicular to the linear direction of the strip conductor is substantially same as a distance between the strip conductor and a center of the loop-shape of each of the plurality of loop elements.

16. An array antenna device comprising:

a substrate;

a strip conductor with a linear-shape, which is provided on the substrate;

a power feeder that feeds power to the strip conductor;

a plurality of loop elements which are provided on a first surface of the substrate, and are located along the strip conductor with a specified spacing from each other, each of the plurality of loop elements having a loop-shape with a notch;

a conductor plate provided on a second surface of the substrate, the second surface being an opposite surface of the first surface; and a plurality of feeding elements provided on the first surface of the substrate, and connected to the strip conductor, each of the plurality of feeding elements having a shape extending along a portion of an outer edge of corresponding one of the plurality of loop elements and being separated from the corresponding one of the plurality of loop elements, wherein each of the plurality of feeding elements has a semicircular ring shape and is provided at a first side of a first straight line obtained by: connecting a center of the notch and a center of a respective loop element with a second straight line and identifying the first straight line as a line that is parallel to the second straight line, tangential to an outer perimeter of the respective loop element and closest to the feeding element of all available straight lines that are tangential to the outer perimeter of the respective loop, the notch being provided on a second side of the first straight line opposite to the first side.

* * * * *